US007918449B2

(12) United States Patent
Sugiyama et al.

(10) Patent No.: US 7,918,449 B2
(45) Date of Patent: Apr. 5, 2011

(54) DOUBLE-SIDED IMAGE FORMING DEVICE

(75) Inventors: Yoshihide Sugiyama, Kinokawa (JP); Kazuya Yamamoto, Kinokawa (JP)

(73) Assignee: Duplo Seiko Corporation, Kinokawa-Shi, Wakayama (JP)

( * ) Notice: Subject to any disclaimer, the term of this patent is extended or adjusted under 35 U.S.C. 154(b) by 151 days.

(21) Appl. No.: 12/439,044

(22) PCT Filed: Apr. 18, 2007

(86) PCT No.: PCT/JP2007/058401
§ 371 (c)(1),
(2), (4) Date: Feb. 26, 2009

(87) PCT Pub. No.: WO2008/035479
PCT Pub. Date: Mar. 27, 2008

(65) Prior Publication Data

US 2010/0019437 A1 Jan. 28, 2010

(30) Foreign Application Priority Data

Sep. 20, 2006 (JP) ..... 2006-254756

(51) Int. Cl.
*B65H 29/00* (2006.01)
*B65H 29/66* (2006.01)
*B65H 5/00* (2006.01)
*B65H 39/10* (2006.01)

(52) U.S. Cl. ..... 271/186; 271/225; 271/291; 271/65

(58) Field of Classification Search ..... 271/186, 271/225, 291, 185, 65; 399/401
See application file for complete search history.

(56) References Cited

U.S. PATENT DOCUMENTS 4,019,435 A * 4/1977 Davis ..... 101/232
(Continued)

FOREIGN PATENT DOCUMENTS

JP 61-111244 A 5/1986
(Continued)

OTHER PUBLICATIONS

Form PCT/ISA/210 (International Search Report) dated Jun. 12, 2007.

(Continued)

*Primary Examiner* — Stefanos Karmis
*Assistant Examiner* — Patrick Cicchino
(74) *Attorney, Agent, or Firm* — Buchanan Ingersoll & Rooney PC

(57) ABSTRACT

A double-sided image forming device includes: a paper feeding section (3); a printing section (4); a first conveyance route (6) for conveying a fed paper sheet (2) to a paper discharge section (8) via the printing section (4); and a second conveyance route (7) for receiving, on its conveyance surface, the paper sheet (2), a first side (21) of which has been printed, from the first conveyance route (6), and for conveying the paper sheet (2) while reversing it, thereby conveying the paper sheet (2) to the upstream side of the printing section (4) in the conveyance direction of the first conveyance route (6), wherein the second conveyance route (7) has a reverse conveyance route (9) for receiving, on its conveyance surface, a second side (22) of the paper sheet (2), and for conveying the paper sheet (2) while reversing it, and wherein the reverse conveyance route (9) is formed by a combination of a plurality of reverse mechanisms each including: a first conveyance section (91) for linearly conveying the paper sheet (2); a reverse section (92) for reversing the conveyed paper sheet (2) while bending it along a curved inner peripheral surface; and a second conveyance section (93) for linearly conveying the reversed paper sheet (2).

9 Claims, 23 Drawing Sheets

U.S. PATENT DOCUMENTS

| | | | | |
|---|---|---|---|---|
| 5,467,179 | A * | 11/1995 | Boeck et al. | 399/384 |
| 5,848,345 | A * | 12/1998 | Stemmle | 399/401 |
| 6,074,334 | A * | 6/2000 | Mennie et al. | 493/438 |
| 6,125,751 | A * | 10/2000 | Korem | 101/180 |
| 6,595,465 | B2 * | 7/2003 | Lamothe | 242/615.21 |
| 6,666,399 | B2 * | 12/2003 | Perdu | 242/615.12 |
| 6,726,198 | B2 * | 4/2004 | Glemser et al. | 271/65 |
| 7,766,322 | B2 * | 8/2010 | Nakamura et al. | 271/184 |
| 2006/0181003 | A1 * | 8/2006 | Agata | 271/186 |
| 2009/0066015 | A1 * | 3/2009 | Sugiyama et al. | 271/225 |
| 2010/0148422 | A1 * | 6/2010 | Kawaguchi et al. | 271/3.22 |
| 2010/0156037 | A1 * | 6/2010 | Yamamoto et al. | 271/225 |

FOREIGN PATENT DOCUMENTS

| | | | |
|---|---|---|---|
| JP | 62-280133 | A | 12/1987 |
| JP | 63-267640 | A | 11/1988 |
| JP | 2-061658 | A | 3/1990 |
| JP | 9-267976 | A | 10/1997 |
| JP | 11-207927 | A | 8/1999 |
| JP | 2003-002547 | A | 1/2003 |
| JP | 2006-103855 | A | 4/2006 |

OTHER PUBLICATIONS

Non-English version of Form PCT/ISA/237 (Written Opinion of the International Searching Authority) dated Jun. 12, 2007.

* cited by examiner

DOUBLE-SIDED IMAGE FORMING DEVICE

TECHNICAL FIELD

The present invention relates to a double-sided image forming device for forming an image on a first side of a paper sheet, and for subsequently reversing the paper sheet and conveying the paper sheet to an image forming section again, thereby forming an image also on a second side of the paper sheet.

BACKGROUND ART

A double-sided image forming device including a mechanism for reversing a paper sheet is disclosed in Patent Documents 1 and 2, for example. In the device disclosed in Patent Document 1, a paper sheet is reversed by performing switchback thereon. Further, in the device disclosed in Patent Document 2, a paper sheet is reversed in a twisting manner. Moreover, other well-known examples of double-sided image forming devices include a device disclosed in Patent Document 3. Besides, well-known examples of mechanisms for reversing paper sheets include devices disclosed in Patent Documents 4 and 5.

Patent Document 1: Japanese Unexamined Patent Application Publication No. 62-280133

Patent Document 2: Japanese Unexamined Patent Application Publication No. 2006-103855

Patent Document 3: Japanese Unexamined Patent Application Publication No. 2003-2547

Patent Document 4: Japanese Unexamined Patent Application Publication No. 63-267640

Patent Document 5: Japanese Unexamined Patent Application Publication No. 11-207927

DISCLOSURE OF THE INVENTION

Problems to be Solved by the Invention

The device disclosed in Patent Document 1 had the following problems.

(1) Since a paper sheet is sandwiched by rollers, a side of the paper sheet, on which an image has been formed, might be rubbed against the rollers and smudged.

(2) Since a roller for performing switchback is temporarily stopped at the time of forward/reverse switching, there is a loss of time.

(3) The roller for performing switchback generates noise at the time of forward/reverse switching.

(4) A paper sheet jam is likely to occur at a position where switchback is performed.

Furthermore, the device disclosed in Patent Document 2 had the following problems.

(1) Since a paper sheet is sandwiched by rollers, a side of the paper sheet, on which an image has been formed, might be rubbed against the rollers and smudged.

(2) A section of the device, at which the paper sheet is reversed in a twisting manner, requires a size sufficiently larger than the length of the paper sheet in the conveyance direction thereof, and therefore, the device is increased in size.

(3) The paper sheet might be deviated obliquely due to the vibration and/or deflection of the conveyance belt at the time of passing of the paper sheet from or to a conveyance belt for reversing the paper sheet in a twisting manner.

An object of the present invention is to provide a double-sided image forming device capable of preventing a side of a paper sheet, on which an image has been formed, from being rubbed and smudged, i.e., capable of forming, without smudging one side of a paper sheet on which an image has been formed, an image also on the other side of the paper sheet, and capable of preventing the occurrence of noise, paper sheet jam, loss of time, oblique deviation, etc. to the extent possible.

Solution to the Problems

The present invention provides a double-sided image forming device for forming an image on a first side of a paper sheet, and for subsequently reversing the paper sheet and conveying the paper sheet to an image forming section again, thereby forming an image also on a second side of the paper sheet, the double-sided image forming device including:

a paper feeding section for feeding a paper sheet;

an image forming section for forming an image on the paper sheet;

a first conveyance route for conveying a fed paper sheet to a paper discharge section via the image forming section; and a second conveyance route for receiving, on its conveyance surface, the paper sheet, on the first side of which an image has been formed, from the first conveyance route, and for conveying the paper sheet while reversing it, thereby conveying the paper sheet to the upstream side of the image forming section in the conveyance direction of the first conveyance route, wherein the second conveyance route has:

a forward guide section for guiding the paper sheet to the second conveyance route so that the second side of the paper sheet conveyed by the first conveyance route is received on the conveyance surface of the second conveyance route;

a reverse conveyance route for receiving, on its conveyance surface, the second side of the paper sheet, and for conveying the paper sheet while reversing it; and a diverting guide for guiding the paper sheet to the first conveyance route so that the first side of the paper sheet conveyed via the reverse conveyance route is received on a conveyance surface of the first conveyance route, and wherein the reverse conveyance route is formed by a combination of a plurality of reverse mechanisms each including: a first conveyance section for linearly conveying the paper sheet by attracting the second side of the paper sheet to a conveyance surface; a reverse section for receiving, on its conveyance surface formed by a curved inner peripheral surface, the second side of the paper sheet conveyed by the first conveyance section, and for reversing the paper sheet while bending it along the curved inner peripheral surface; and a second conveyance section for linearly conveying the paper sheet by attracting the second side of the reversed paper sheet to a conveyance surface, and the continuous reverse mechanisms are combined so that the second conveyance section of the preceding reverse mechanism also serves as the first conveyance section of the subsequent reverse mechanism.

The present invention may further adopt the following structure(s).

(1) The forward guide section includes a suction roller that is rotated with the second side of the paper sheet attracted thereto.

(2) The first conveyance section and/or the second conveyance section include(s): a conveyance belt having a large number of through holes; and a suction unit for sucking air through these through holes.

(3) The first conveyance section and/or the second conveyance section include(s): a conveyance belt; and charging means for electrostatically charging the conveyance belt.

(4) The second conveyance route further has: one or more third conveyance sections for linearly conveying the paper sheet by attracting the second side of the paper sheet to a conveyance surface; and a forward guide section located between the reverse conveyance route and the third conveyance section, the forward guide section guides the paper sheet to the subsequent section so that the second side of the paper sheet conveyed by the preceding section, which is one of the reverse conveyance route and the third conveyance section, is received on the conveyance surface of the subsequent section, which is the other one of the reverse conveyance route and the third conveyance section, and the forward guide section includes a suction roller that is rotated with the second side of the paper sheet attracted thereto.

(5) The paper feeding section is located below the image forming section, the reverse conveyance route is located next to the paper feeding section, and a third conveyance section for linearly conveying the paper sheet by attracting the second side of the paper sheet to a conveyance surface is located so as to pass below the paper feeding section to reach the first conveyance route.

(6) The paper feeding section is located below the image forming section, the reverse conveyance route is located next to the paper feeding section, and a third conveyance section for linearly conveying the paper sheet by attracting the second side of the paper sheet to a conveyance surface is located so as to pass above the paper feeding section and below the image forming section to reach the first conveyance route.

(7) The paper feeding section is located below the image forming section, and the reverse conveyance route is located above the paper feeding section and below the image forming section.

(8) The paper feeding section is located below the image forming section, and the reverse conveyance route is located above the image forming section.

Effects of the Invention

According to the present invention, the following effects can be achieved.

(i) The reverse conveyance route is formed without using rollers for sandwiching the paper sheet; therefore, in the reverse conveyance route, it is possible to convey the paper sheet without bringing the first side, on which an image has been formed, into contact with any object. Accordingly, in the reverse conveyance route, it is possible to prevent the first side, on which an image has been formed, from being rubbed against any object and smudged. Hence, in the step of conveying the paper sheet to the image forming section again in order to form an image on the second side, the first side can be effectively prevented from being smudged, thus making it possible to obtain the paper sheet on which the images formed on both sides are beautiful.

(ii) The reverse conveyance route is formed without using rollers for sandwiching the paper sheet; therefore, it is possible to prevent loss of time, noise, and paper sheet jam, which have occurred in the case of the conventional switchback system.

(iii) The reverse conveyance route is formed by a combination of a plurality of the reverse mechanisms for linearly conveying the paper sheet, reversing the paper sheet along the curved inner peripheral surface, and further linearly conveying the paper sheet; therefore, it is possible to further achieve the following effects.

(a) The longitudinal size of the reverse conveyance route can be smaller than that of the paper sheet in the conveyance direction. Accordingly, the size of the entire device can be reduced.

(b) Since the paper sheet is linearly conveyed when it goes into the reverse conveyance route, and is linearly conveyed when it goes out of the reverse conveyance route, the paper sheet can be prevented from being deviated obliquely.

In the foregoing structure (1), the conveyance of the paper sheet from the first conveyance route to the second conveyance route can be performed without bringing the first side, on which an image has been formed, into contact with any object. Accordingly, also in this structure, it is possible to prevent the first side, on which an image has been formed, from being rubbed against any object and smudged in the second conveyance route.

In the foregoing structure (2) or (3), the reverse conveyance route can be simply formed.

In the foregoing structure (4), the conveyance of the paper sheet between the reverse conveyance route and the third conveyance section can be performed without bringing the first side, on which an image has been formed, into contact with any object. Accordingly, also in this structure, it is possible to prevent the first side, on which an image has been formed, from being rubbed against any object and smudged in the second conveyance route.

In the foregoing structure (5), since the second conveyance route is located around the device main body, the entire device can be compact in size.

In the foregoing structure (6), a space below the paper feeding section can be open, thus making it possible to add a paper feeding cassette.

In the foregoing structure (7), the lateral size of the device main body is reduced, thereby allowing the entire device to be more compact in size. Furthermore, a space below the paper feeding section can be open, thus making it possible to add a paper feeding cassette.

In the foregoing structure (8), the lateral size of the device main body is reduced, thereby allowing the entire device to be more compact in size. Furthermore, even if a paper sheet jam has occurred in the reverse conveyance route, an operation for clearing the jam can be easily performed from above. Moreover, a space below the paper feeding section can be open, thus making it possible to add a paper feeding cassette.

DESCRIPTION OF REFERENCE NUMERALS

Figure 1:
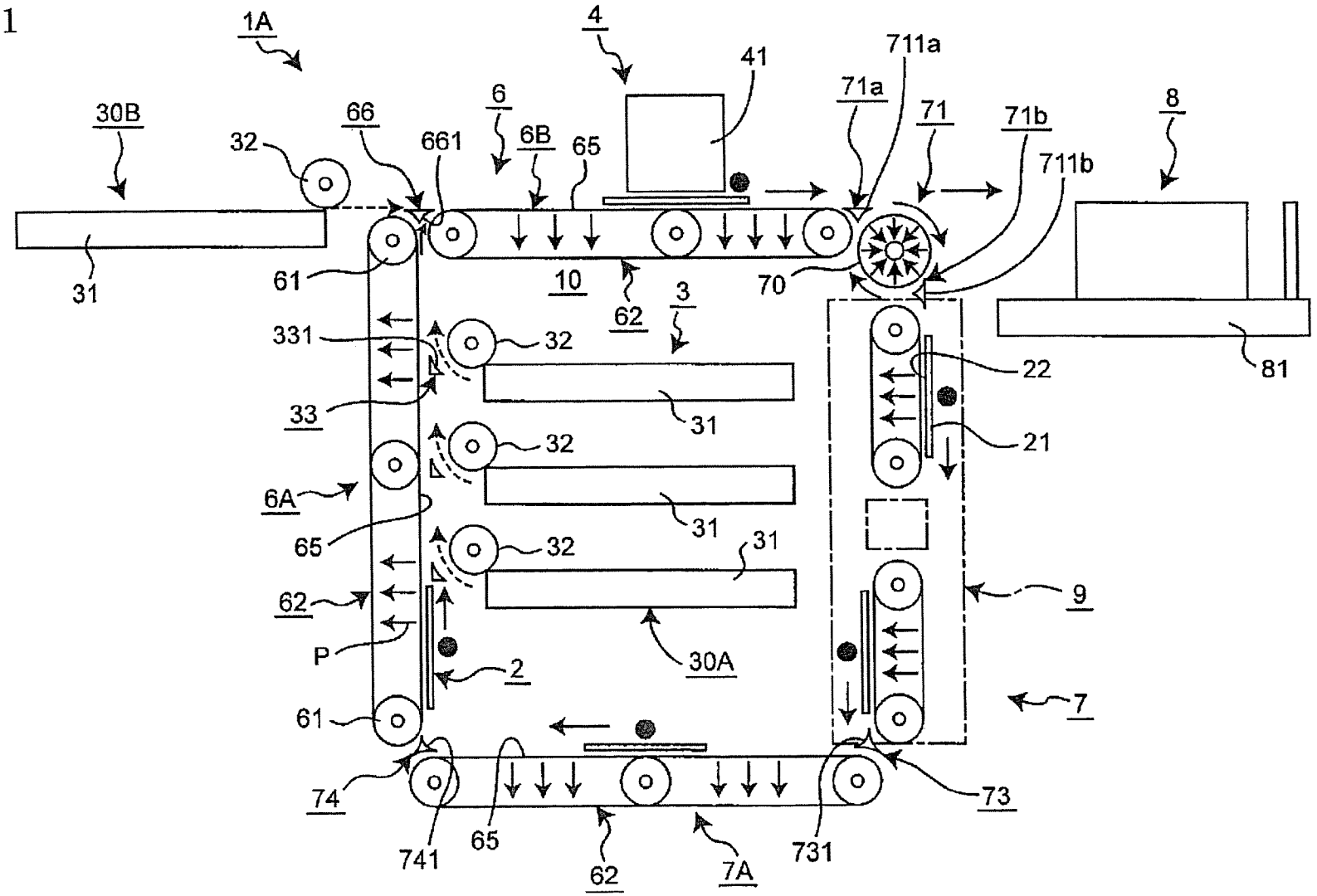
FIG. 1 is a schematic lateral cross-sectional view mainly showing conveyance routes of a double-sided printing device according to a first embodiment of the present invention.

1A, 1B, 1C, 1D double-sided printing device
2 paper sheet
21 first side
22 second side
3 paper feeding section
4 printing section (image forming section)
6 first conveyance route
66, 79 diverting guide
7 second conveyance route
70 suction roller
7A, 7B conveyance section (third conveyance section)
71, 75, 76 forward guide section
8 paper discharge section
9 reverse conveyance route
91 first conveyance section
92 reverse section
93 second conveyance section
912, 932 conveyance belt
914, 934 suction unit

BEST MODE FOR CARRYING OUT THE INVENTION

The present invention relates to double-sided image forming devices, each of which forms an image on one side of a paper sheet, and subsequently reverses the paper sheet to convey the paper sheet to an image forming section again, thereby forming an image also on the other side of the paper sheet. The double-sided image forming devices include a double-sided printing device, a double-sided copying device, etc. Herein, sides of a paper sheet will be referred to as a first side and a second side, and the side of the paper sheet, on which an image is formed first, will be referred to as the first side.

First Embodiment

Figure 2:
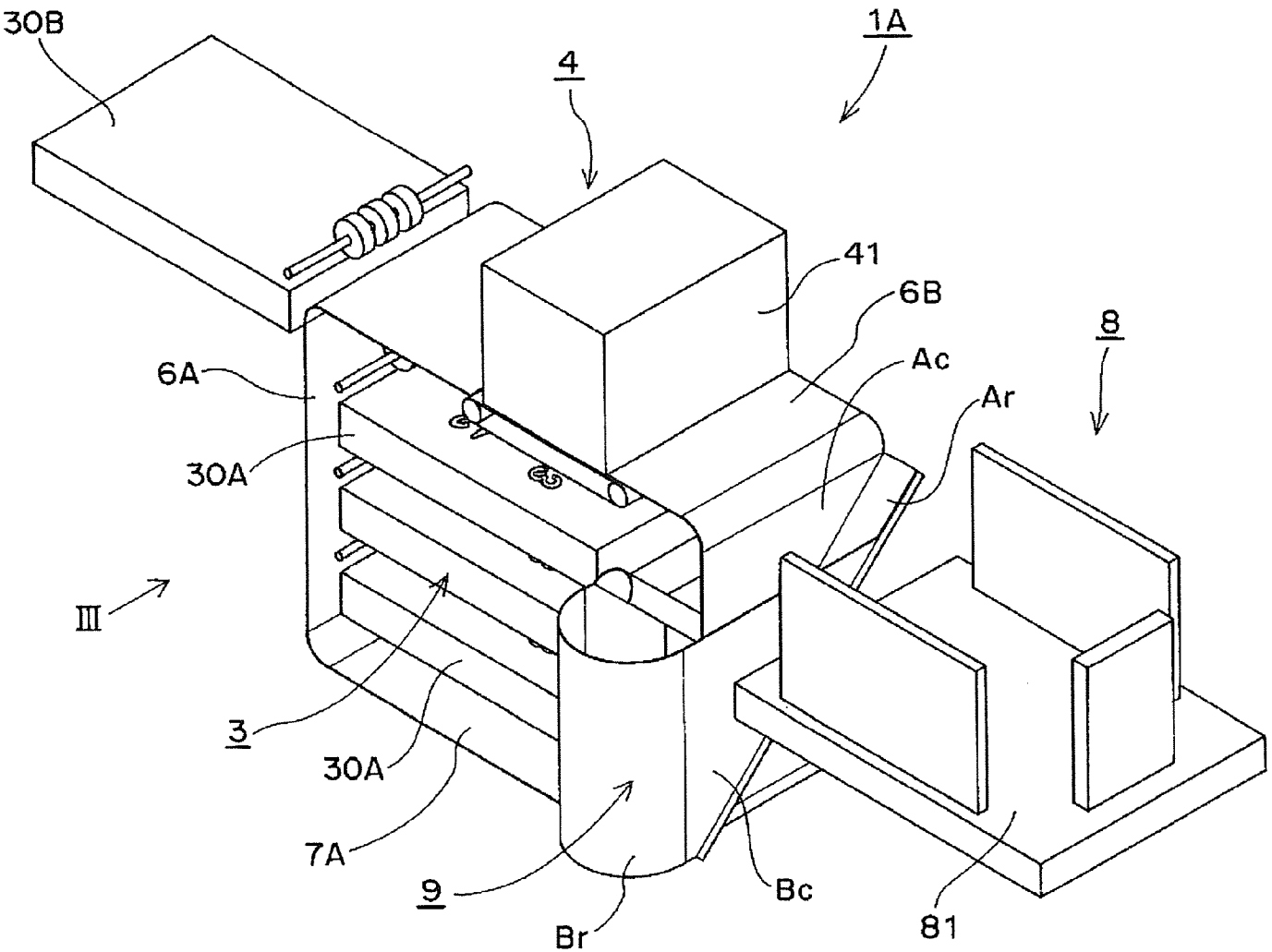
FIG. 2 is a schematic external perspective view of the double-sided printing device shown in FIG. 1.
Figure 3:
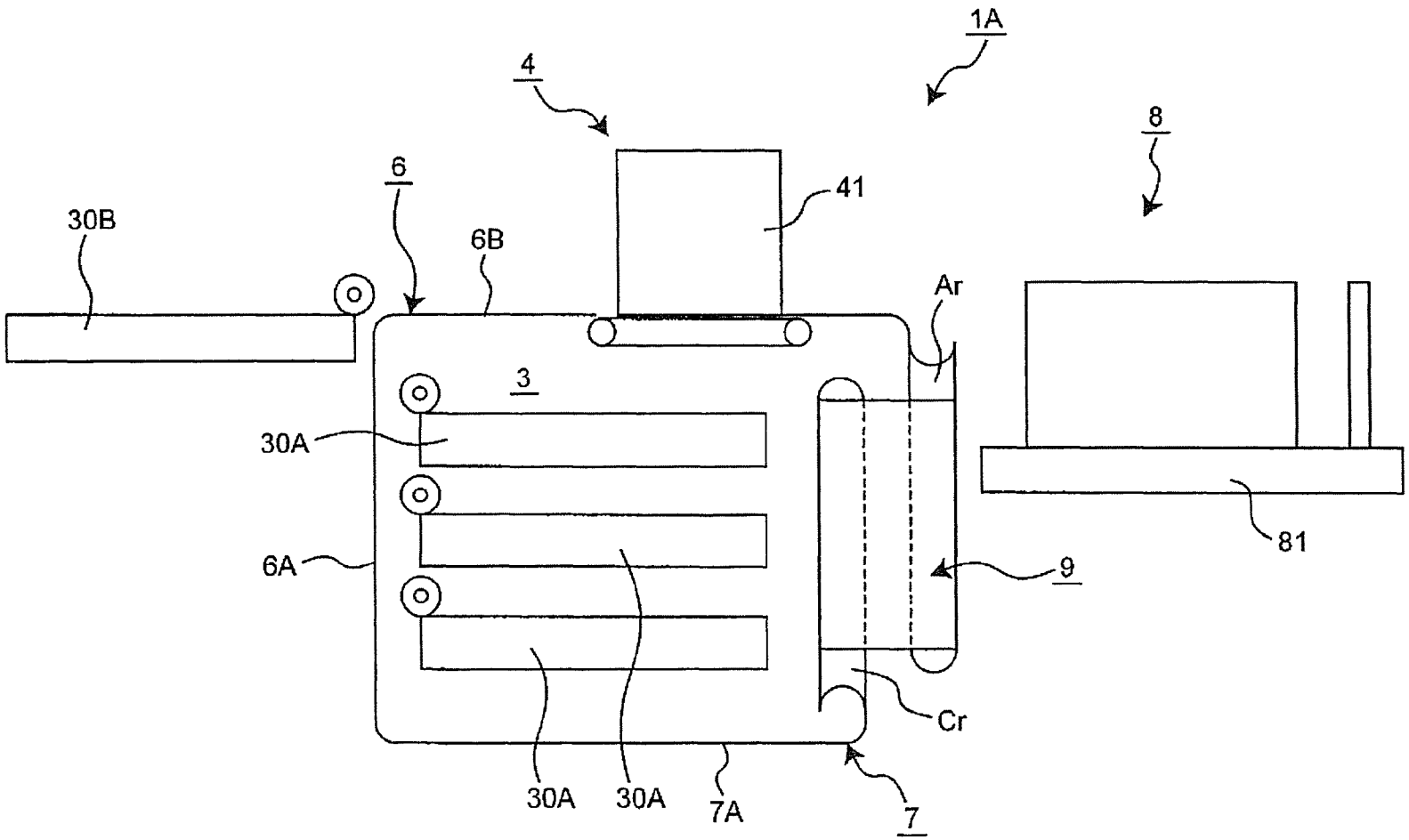
FIG. 3 is a diagram viewed from the arrow III of FIG. 2.
Figure 4:
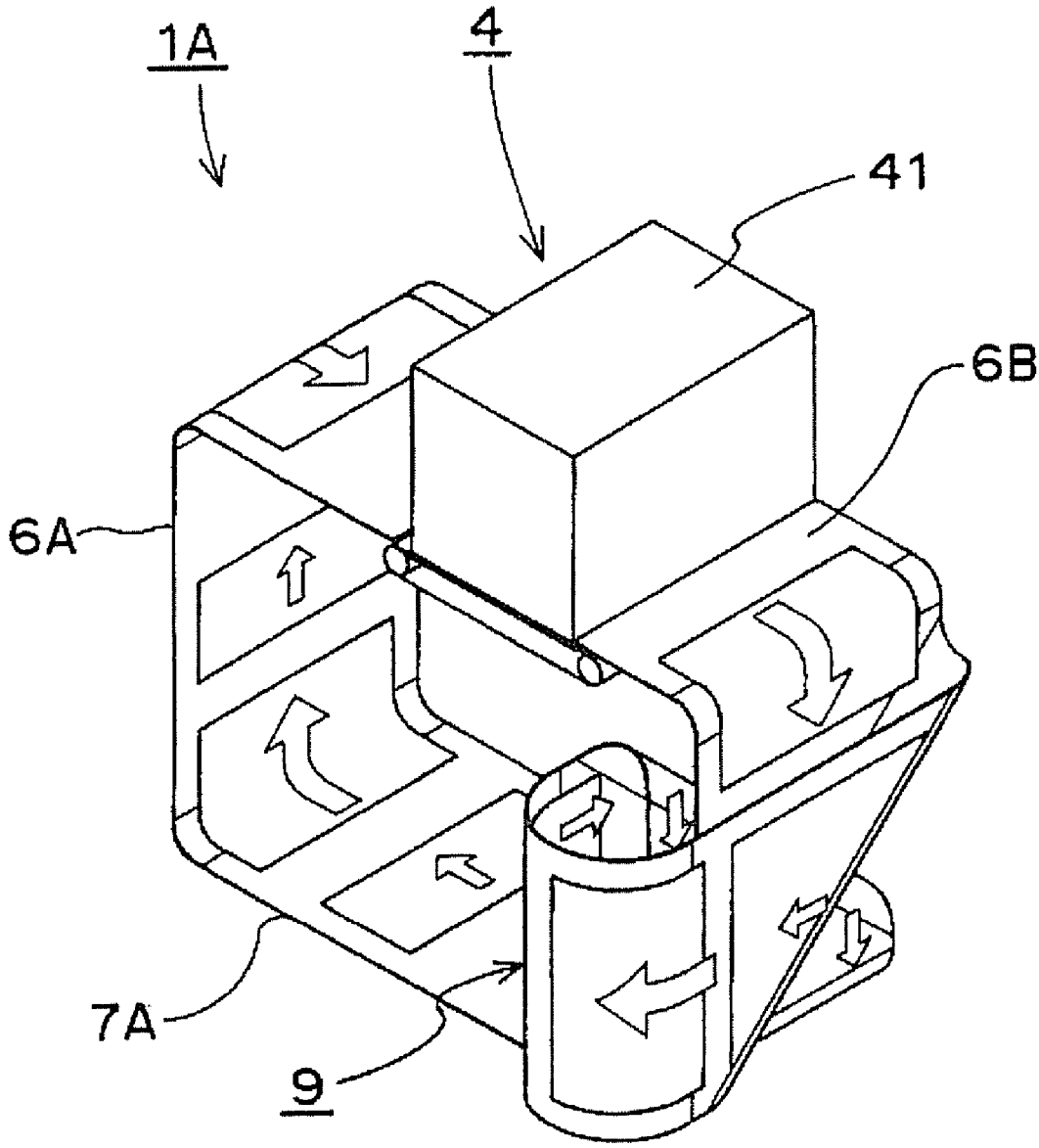
FIG. 4 is a schematic external perspective view showing the flow of a paper sheet conveyed in the double-sided printing device shown in FIG. 1.

FIG. 1 is a schematic lateral cross-sectional view mainly showing conveyance routes of a double-sided printing device according to a first embodiment of the present invention. FIG. 2 is a schematic external perspective view of the double-sided printing device shown in FIG. 1. FIG. 3 is a diagram viewed from the arrow III of FIG. 2. FIG. 4 is a schematic external perspective view showing the flow of a paper sheet conveyed in the double-sided printing device shown in FIG. 1.

This double-sided printing device 1A includes: a paper feeding section 3 for feeding a paper sheet 2; a printing section 4 for performing printing on the paper sheet 2; a first conveyance route 6; a second conveyance route 7; and a paper discharge section 8. The printing section 4, and the paper feeding section 3 located therebelow constitute a device main body 10. The first conveyance route 6 is formed so as to convey the fed paper sheet 2 to the paper discharge section 8 via the printing section 4. The second conveyance route 7 is formed so as to receive, on its conveyance surface, the paper sheet 2, the first side 21 of which has been printed, from the first conveyance route 6, and to convey the paper sheet 2 while reversing it, thereby conveying the paper sheet 2 to the upstream side of the printing section 4 in the conveyance direction of the first conveyance route 6. In FIG. 1, the first side 21 of the paper sheet 2 is identified by black circles.

The paper feeding section 3 includes a plurality of (in this embodiment, three) paper feeding units 30A, each including: a paper feeding tray 31; a paper feeding roller 32; and a paper feeding guide 33. The paper feeding units 30A are arranged so as to be vertically aligned blow the printing section 4. In other words, the paper feeding section 3 is located below the printing section 4. Each paper feeding guide 33 guides the paper sheet 2, which has been pulled out from the paper feeding tray 31 by the paper feeding roller 32, to the first conveyance route 6 along a curved surface 331. It should be noted that the present device is also provided with an externally attached paper feeding unit 30B. The paper feeding unit 30B includes a paper feeding tray 31 and a paper feeding roller 32. The paper feeding unit 30B is a manual paper feeding unit or the like, for example, and can send out the paper sheet 2 to the first conveyance route 6 similarly to the paper feeding units 30A.

The printing section 4 includes an ink jet head 41. The paper discharge section 8 is communicated with a terminal end of the first conveyance route 6, and includes a paper discharge tray 81.

The first conveyance route 6 has: a conveyance section 6A extending longitudinally in front of the three paper feeding units 30A located below the printing section 4, i.e., in front of the device main body 10; and a conveyance section 6B extending laterally so as to be communicated with the conveyance section 6A orthogonally in side view. The conveyance section 6B is communicated with the paper discharge section 8 via the printing section 4. The conveyance section 6B is communicated, at its starting end, with the externally attached paper feeding unit 30B.

Figure 5:
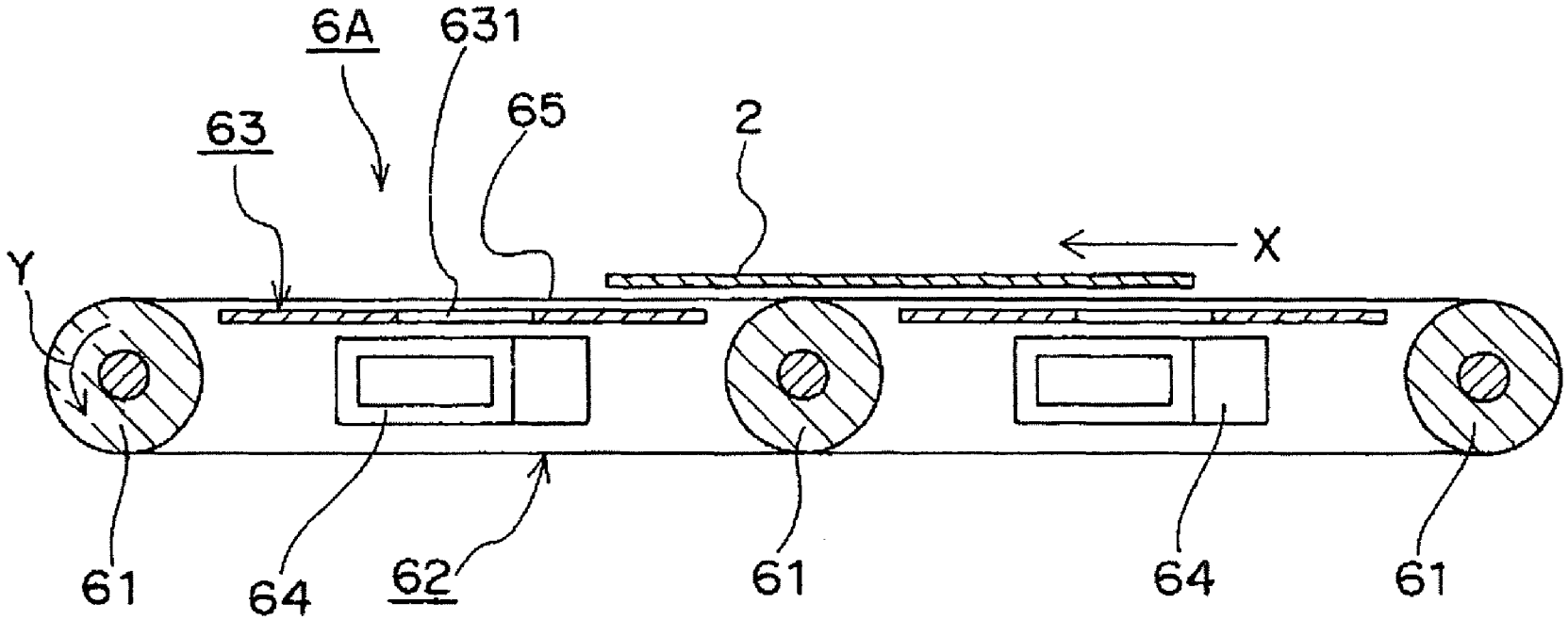
FIG. 5 is a longitudinal cross-sectional view showing a conveyance section.

As shown in FIG. 5, the conveyance section 6A includes: a conveyance belt 62 running between a plurality of conveyance rollers 61 and having a large number of through holes (not shown); a conveyance plate 63 provided at the bottom side of a conveyance surface 65 formed by the conveyance belt 62; and suction units 64 for sucking the conveyance belt 62, which forms the conveyance surface 65, via a through hole 631 of the conveyance plate 63. Arrows P in the conveyance section 6A of FIG. 1 each indicate a suction direction. Thus, the conveyance section 6A attracts the paper sheet 2 to the conveyance surface 65, and linearly conveys the paper sheet 2 in the direction of an arrow X due to the movement of the conveyance belt 62 in the direction of the arrow X associated with rotations of the conveyance rollers 61 in the direction of an arrow Y. The conveyance section 6B also has a structure similar to that of the conveyance section 6A.

Between a terminal end of the conveyance section 6A and the starting end of the conveyance section 6B, a diverting guide 66 is located. The diverting guide 66 not only guides the paper sheet 2, conveyed by the conveyance section 6A, to the conveyance section 6B along a curved surface 661, but also guides the paper sheet 2 to the conveyance section 6B while bending the paper sheet 2 so that the side of the paper sheet 2, opposite to the side thereof which has been received on the conveyance surface 65 of the conveyance section 6A, is received on the conveyance surface 65 of the conveyance section 6B.

The second conveyance route 7 includes: a forward guide section 71; a reverse conveyance route 9; a conveyance section 7A (third conveyance section); and the diverting guide 66. It should be noted that the second conveyance route 7 also uses the conveyance section 6A of the first conveyance route 6. Further, the diverting guide 66 is one that is located in the first conveyance route 6. The reverse conveyance route 9 is communicated with the terminal end of the first conveyance route 6, and is longitudinally extending downward. The conveyance section 7A is communicated with a terminal end of the reverse conveyance route 9, and extends laterally so as to be communicated with a starting end of the conveyance section 6A of the first conveyance route 6. The reverse conveyance route 9 is located next to the paper feeding section 3. The conveyance section 7A passes below the paper feeding section 3. The forward guide section 71 is located between a terminal end of the conveyance section 6B of the first conveyance route 6 and a starting end of the reverse conveyance route 9 of the second conveyance route 7.

The conveyance section 7A has a structure similar to that of the conveyance section 6A.

Figure 6:
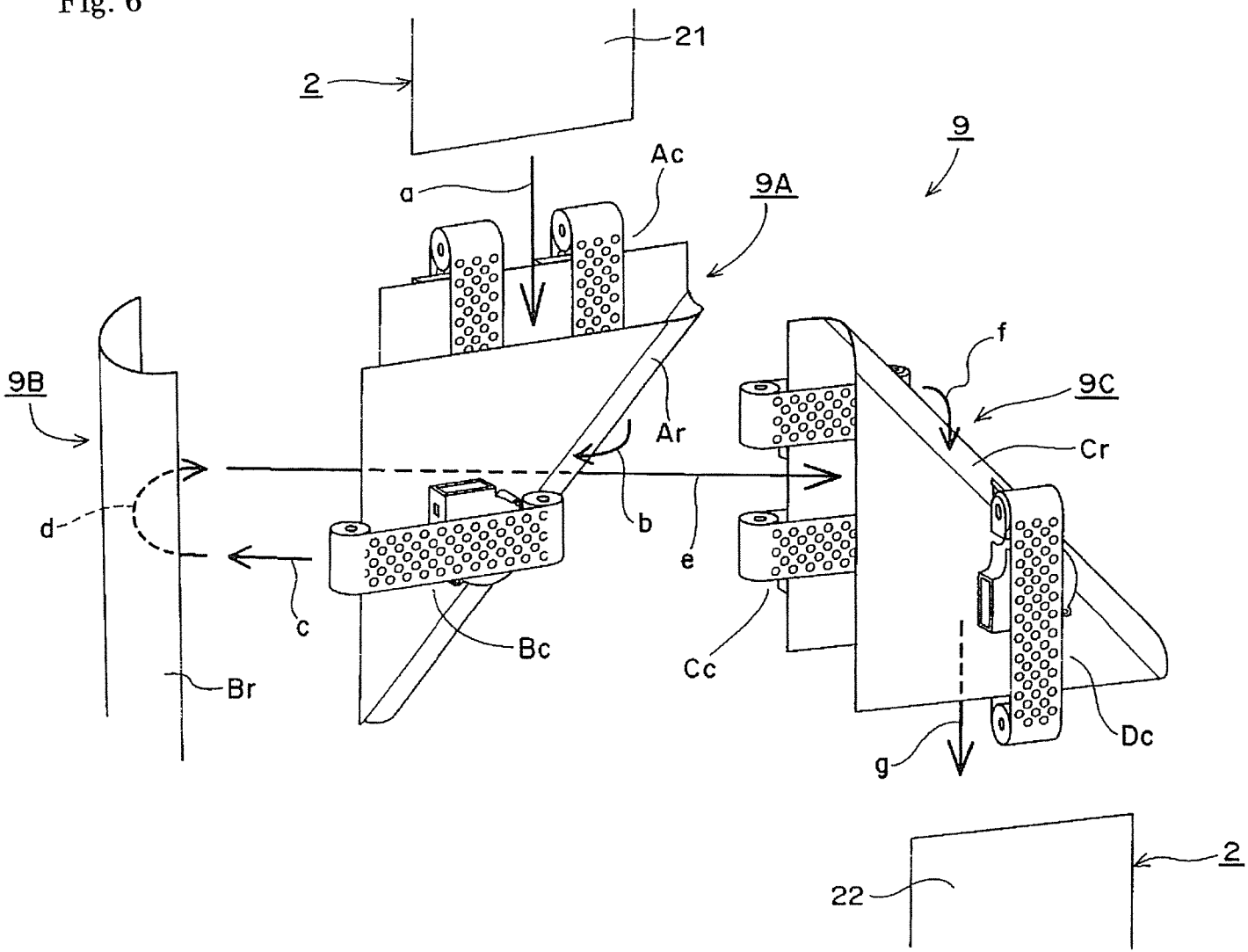
FIG. 6 is an exploded view showing a reverse conveyance route according to the first embodiment.

The reverse conveyance route 9 receives, on its conveyance surface, a second side 22 of the paper sheet 2, and conveys the paper sheet 2 while reversing it. As shown in FIG. 6, the reverse conveyance route 9 is formed by a combination of three reverse mechanisms 9A, 9B and 9C.

Figure 7:
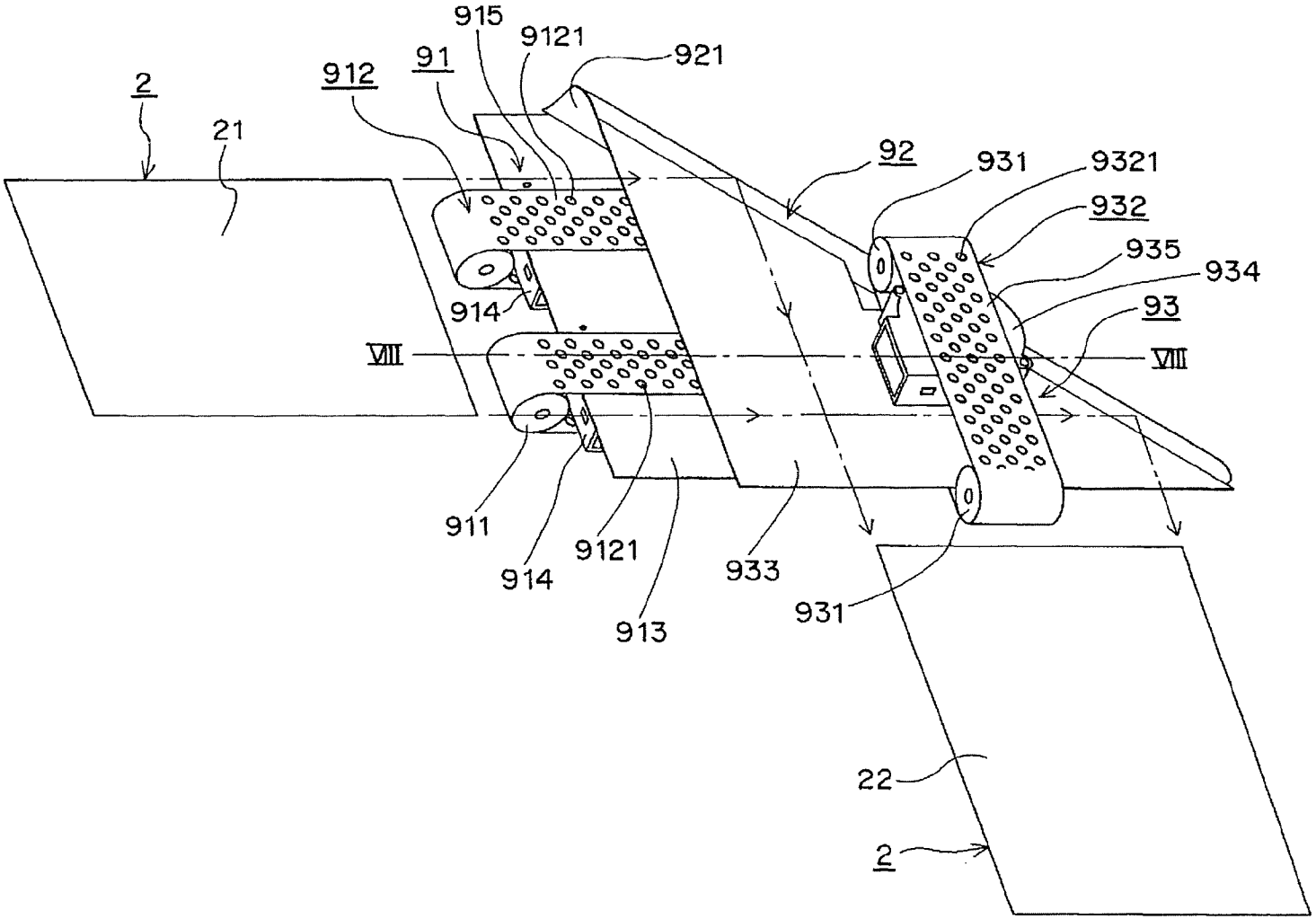
FIG. 7 is a perspective view showing one of reverse mechanisms.
Figure 8:
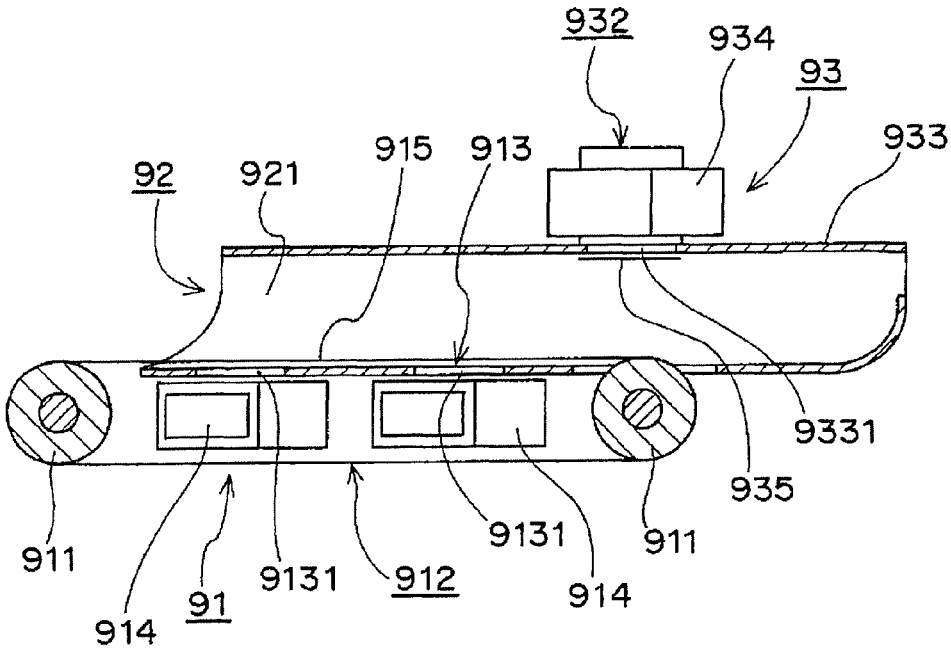
FIG. 8 is a cross-sectional view taken along the line VIII-VIII of FIG. 7.

As shown in FIG. 7, one of the reverse mechanisms consists of: a first conveyance section 91 for linearly conveying the paper sheet 2 by attracting it to the conveyance surface; a reverse section 92 for receiving, on its conveyance surface formed by a curved inner peripheral surface, the paper sheet 2 conveyed by the first conveyance section 91, and for reversing the paper sheet 2 while bending it along the curved inner peripheral surface; and a second conveyance section 93 for linearly conveying the reversed paper sheet 2 by attracting it to the conveyance surface. The first conveyance section 91 and the second conveyance section 93 have a parallel relationship. FIG. 8 is a cross-sectional view taken along the line VIII-VIII of FIG. 7.

The first conveyance section 91 includes: conveyance belts 912 running between conveyance rollers 911 and having a large number of through holes 9121; a conveyance plate 913 provided at the bottom side of a conveyance surface 915 formed by the conveyance belts 912; and suction units 914 for sucking the conveyance belts 912, which form the conveyance surface 915, via a through hole 9131 of the conveyance plate 913. It should be noted that the single conveyance belt 912 and the two suction units 914 are provided in two sets in the example shown in FIG. 7; however, only one set of the single conveyance belt 912 and the two suction units 914 may be provided. Alternatively, the single conveyance belt 912 and the single suction unit 914 may be provided in one or more sets.

The reverse section 92 is a trough-like body having a curved inner peripheral surface serving as a conveyance surface 921.

The second conveyance section 93 includes: a conveyance belt 932 running between conveyance rollers 931 and having a large number of through holes 9321; a conveyance plate 933 provided at the bottom side of a conveyance surface 935 formed by the conveyance belt 932; and a suction unit 934 for sucking the conveyance belt 932, which forms the conveyance surface 935, via a through hole 9331 of the conveyance plate 933. In the example shown in FIG. 7, one set of the conveyance belt 932 and the suction unit 934 is provided, but the conveyance belt 932 and the suction unit 934 may be provided in two or more sets.

Further, the conveyance surfaces 915, 921 and 935 form a continuous conveyance surface. Furthermore, the conveyance surfaces 915 and 935 have a parallel relationship, and in FIG. 7, the conveyance surface 915 is located at the front side, while the conveyance surface 935 is located at the bottom side.

Accordingly, one of the reverse mechanisms shown in FIG. 7 receives, on the conveyance surface 915, the second side 22 of the paper sheet 2 in the first conveyance section 91, conveys the paper sheet 2 to the reverse section 92 by attracting the paper sheet 2 with the conveyance belts 912, reverses the paper sheet 2 along the curved inner peripheral surface, serving as the conveyance surface 921, in the reverse section 92, and then receives, on the conveyance surface 935, the second side 22 of the paper sheet 2 in the second conveyance section 93 to convey the paper sheet 2 by attracting it with the conveyance belt 932. Thus, one of the reverse mechanisms reverses the paper sheet 2 conveyed to the first conveyance section 91, and sends out the reversed paper sheet 2 from the second conveyance section 93.

Furthermore, in the reverse conveyance route 9 of the present embodiment, as shown in FIG. 6, the reverse mechanism 9A is formed by a conveyance section Ac, a reverse section Ar, and a conveyance section Bc, the reverse mechanism 9B is formed by the conveyance section Bc, a reverse section Br, and a conveyance section Cc, and the reverse mechanism 9C is formed by the conveyance section Cc, a reverse section Cr, and a conveyance section Dc. In other words, the conveyance section Ac serves as a first conveyance section of the reverse mechanism 9A, the conveyance section Bc serves as both of a second conveyance section of the reverse mechanism 9A and a first conveyance section of the reverse mechanism 9B, the conveyance section Cc serves as both of a second conveyance section of the reverse mechanism 9B and a first conveyance section of the reverse mechanism 9C, and the conveyance section Dc serves as a second conveyance section of the reverse mechanism 9C.

Figure 9:
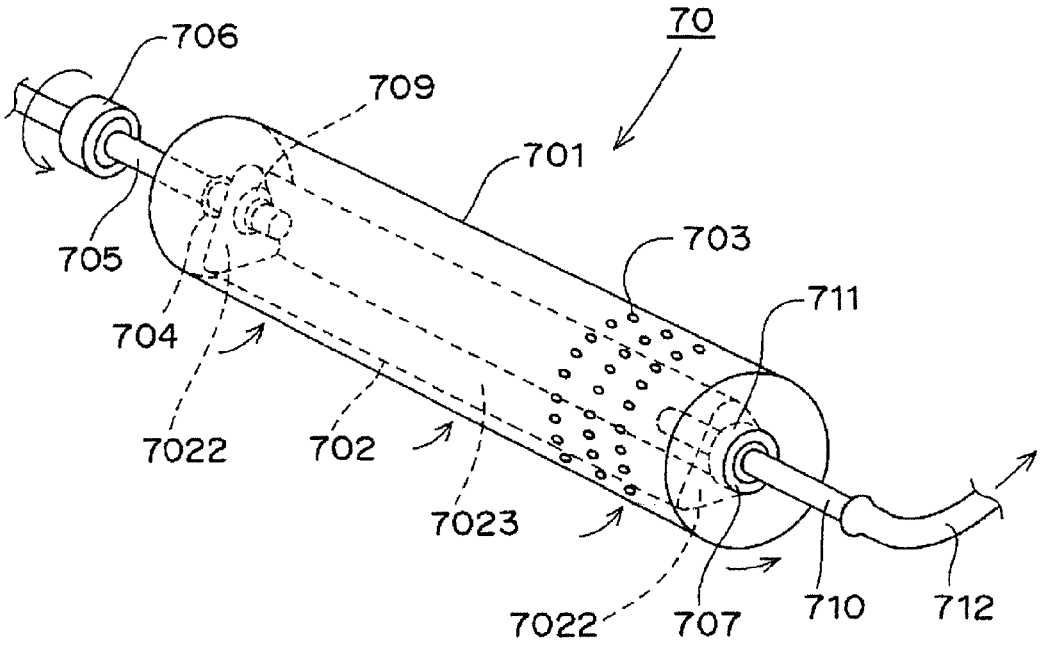
FIG. 9 is a perspective view of a suction roller.
Figure 10:
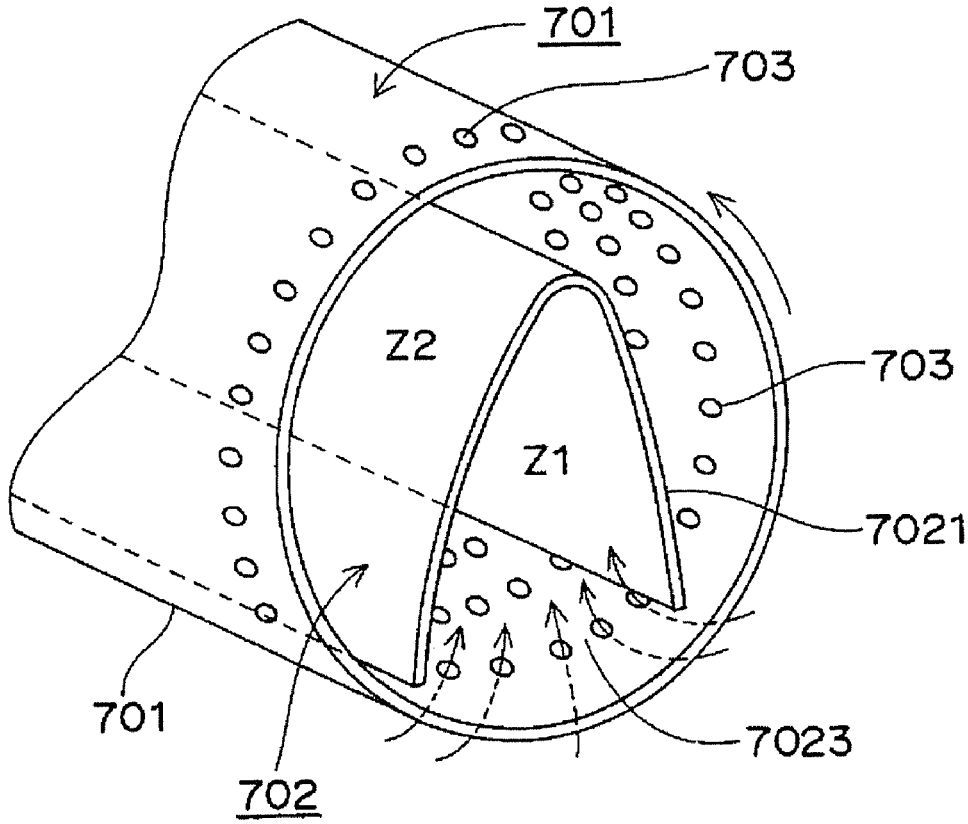
FIG. 10 is an enlarged exploded perspective view of the suction roller.
Figure 11:
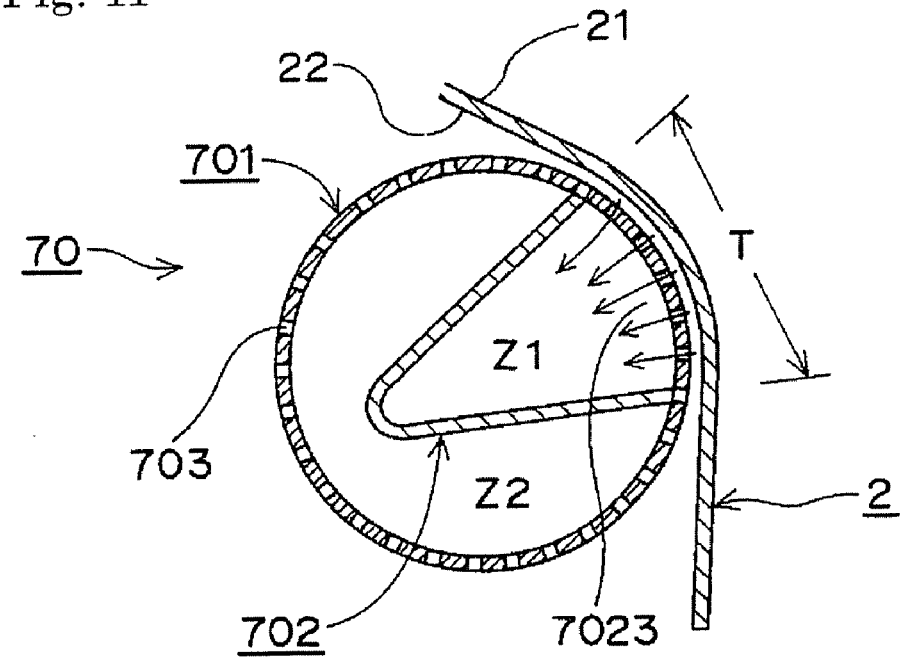
FIG. 11 is a longitudinal cross-sectional view showing an operating state of the suction roller.

The forward guide section 71 includes a suction roller 70 that is rotated with the second side 22 of the paper sheet 2 attracted thereto. Specifically, the suction roller 70 has a structure shown in FIGS. 9 and 10. More specifically, the suction roller 70 includes: a hollow cylindrical roller portion 701 that is rotatably provided; and a partition member 702 provided within the roller portion 701 so as not to be rotated. The roller portion 701 has a large number of suction holes 703 passing through a tubular wall. The roller portion 701 is connected, at its one end 704, to a drive shaft 705. The roller portion 701 is rotatably supported by bearings 706 and 707, and is rotationally driven by the drive shaft 705. The partition member 702 is formed by: a plate body 7021 bent in an approximate L shape; and end walls 7022 for closing both ends of the plate body 7021, and has an opening 7023. As shown in FIG. 11, the opening 7023 is opposed to a portion T serving as a conveyance surface of the roller portion 701. At one of the end walls 7022 of the partition member 702, a bearing 709 for supporting the drive shaft 705 is fixed. The partition member 702 partitions an inner space of the roller portion 701 into: a first space Z1 opposed to the portion T; and a second space Z2 located outside of the first space Z1. A suction pipe 710 is inserted into the first space Z1. The suction pipe 710 passes through an end wall 711 of the roller portion 701, and sucks air from the first space Z1 via a tube 712 by means of a suction pump (not shown). Accordingly, as shown in FIG. 11, due to an operation of the suction pump, air is sucked through the suction holes 703 at the portion T of the roller portion 701, and the paper sheet 2 is attracted to the portion T and conveyed with a rotation of the roller portion 701.

Moreover, the forward guide section 71 includes: a conveyance guide 71*a* at the front side of the suction roller 70 in the conveyance direction thereof; and a conveyance guide 71*b* at the rear side of the suction roller 70 in the conveyance direction thereof. The conveyance guide 71*a* guides the paper sheet 2, conveyed by the conveyance section 6B, to the suction roller 70 along a peripheral surface 711*a*, and the conveyance guide 71*b* guides the paper sheet 2, conveyed by the suction roller 70, to the reverse conveyance route 9 along a peripheral surface 711*b*.

Besides, in the second conveyance route 7, a conveyance guide 73 is located between the terminal end of the reverse conveyance route 9 and a starting end of the conveyance section 7A. The conveyance guide 73 guides the paper sheet 2, sent out from the reverse conveyance route 9, to the conveyance section 7A along a curved surface 731.

In addition, a conveyance guide 74 is located between a terminal end of the conveyance section 7A of the second conveyance route 7 and the starting end of the conveyance section 6A of the first conveyance route 6. The conveyance guide 74 guides the paper sheet 2, conveyed by the conveyance section 7A, to the conveyance section 6A along a curved surface 741.

Hereinafter, how the double-sided printing device with the above-described structure operates will be described mainly with reference to FIG. 1.

Upon operation of the device, first, the uppermost one of the paper sheets 2 stacked on the paper feeding tray 31 is pulled out from the paper feeding tray 31 by the paper feeding roller 32, and is sent out to the conveyance section 6A of the first conveyance route 6 along the curved surface 331 of the paper feeding guide 33. At this time, since the paper sheets 2 are stacked on the paper feeding tray 31 with the second sides 22 up, the paper sheet 2 is moved while the first side 21 is brought into contact with the curved surface 331, and the first side 21 is received on the conveyance surface 65. Accordingly, the paper sheet 2 is conveyed upward by the conveyance section 6A with the first side 21 attracted to the conveyance belt 62.

Next, the paper sheet 2 conveyed by the conveyance section 6A is guided to the conveyance section 6B along the curved surface 661 of the diverting guide 66, and is placed onto the conveyance surface 65 of the conveyance section 6B. At this time, the paper sheet 2 is moved while the first side 21 is brought into contact with the curved surface 661, and the paper sheet 2 is reversed and placed onto the conveyance surface 65; therefore, the second side 22 is received on the conveyance surface 65. Accordingly, the paper sheet 2 is conveyed laterally by the conveyance section 6B with the second side 22 attracted to the conveyance belt 62. Then, the first side 21 is printed when the paper sheet 2 goes through the printing section 4.

Subsequently, upon conveyance to the terminal end of the conveyance section 6B, the paper sheet 2, the first side 21 of which has been printed, is guided to the suction roller 70 along the peripheral surface 711*a* of the conveyance guide 71*a*. At this time, since the suction roller 70 is set in a suction operation state, the paper sheet 2 is conveyed by the suction roller 70, and is guided to the reverse conveyance route 9 along the peripheral surface 711*b* of the conveyance guide 71*b*. As shown in FIG. 11, via the suction roller 70, the second side 22 is attracted to the portion T of the roller portion 701, and the paper sheet 2 is conveyed with a rotation of the roller portion 701. Further, since the paper sheet 2 is guided by the conveyance guides 71*a* and 71*b* that are located at the front and rear sides of the suction roller 70 in the conveyance direction thereof, respectively, the conveyance of the paper sheet 2 from the conveyance section 6B to the reverse conveyance route 9 is more smoothly performed.

Then, in the reverse conveyance route 9, the paper sheet 2 is conveyed while being reversed as follows. Specifically, as shown in FIG. 6, the paper sheet 2 sent by the suction roller 70 is linearly conveyed in the direction of an arrow a by the conveyance section Ac, reversed as indicated by an arrow b by the reverse section Ar, linearly conveyed in the direction of an arrow c by the conveyance section Bc, reversed as indicated by an arrow d by the reverse section Br, linearly conveyed in the direction of an arrow e by the conveyance section Cc, reversed as indicated by an arrow f by the reverse section Cr, and then linearly conveyed in the direction of an arrow g by the conveyance section Dc. At this time, the second side 22 of the paper sheet 2 is received on all the conveyance surfaces. Furthermore, the direction in which the paper sheet 2 is conveyed when it goes into the conveyance section Ac (i.e., the direction of the arrow a) is identical to the direction in which the paper sheet 2 is conveyed when it goes out of the conveyance section Dc (i.e., the direction of the arrow g), and the paper sheet 2 is reversed through the reverse conveyance route 9.

Next, the paper sheet 2 conveyed by the conveyance section Dc of the reverse conveyance route 9 is guided to the conveyance section 7A along the curved surface 731 of the conveyance guide 73. At this time, since the paper sheet 2 is moved while the second side 22 is brought into contact with the curved surface 731, the second side 22 is received on the conveyance surface 65 of the conveyance section 7A. Accordingly, the paper sheet 2 is conveyed laterally by the conveyance section 7A with the second side 22 attracted to the conveyance belt 62.

Subsequently, the paper sheet 2 conveyed to the terminal end of the conveyance section 7A is guided to the conveyance section 6A along the curved surface 741 of the conveyance guide 74. At this time, since the paper sheet 2 is moved while the second side 22 is brought into contact with the curved surface 741, the second side 22 is received on the conveyance surface 65 of the conveyance section 6A. Accordingly, the paper sheet 2 is conveyed upward by the conveyance section 6A with the second side 22 attracted to the conveyance belt 62.

Next, the paper sheet 2 conveyed by the conveyance section 6A is guided to the conveyance section 6B along the curved surface 661 of the diverting guide 66, and is placed onto the conveyance surface 65 of the conveyance section 6B. At this time, since the second side 22 of the paper sheet 2 conveyed by the conveyance section 6A is received on the conveyance surface 65, the paper sheet 2 is moved while the second side 22 is brought into contact with the curved surface 661 so that the paper sheet 2 is reversed, and the first side 21 is received on the conveyance surface 65 of the conveyance section 6B. Accordingly, the paper sheet 2 is conveyed laterally by the conveyance section 6B with the first side 21 attracted to the conveyance belt 62. Then, the second side 22 is printed when the paper sheet 2 goes through the printing section 4.

Then, upon conveyance to the terminal end of the conveyance section 6B, the paper sheet 2, the second side 22 of which has been printed, is guided to the suction roller 70 along the peripheral surface 711*a* of the conveyance guide 71*a;* however, at this time, since the suction roller 70 is set in a non-suction operation state, the paper sheet 2 is automatically guided to the paper discharge section 8 and is stored in the paper discharge tray 81.

Thus, the paper sheet 2, both sides of which, i.e., the first side 21 and the second side 22 of which, have been printed, is obtained.

The double-sided printing device with the above-described structure can achieve the following effects.

(1) The reverse conveyance route 9 is formed without using rollers for sandwiching the paper sheet 2; therefore, in the reverse conveyance route 9, it is possible to convey the paper sheet 2 without bringing the printed first side 21 into contact with any object. Accordingly, in the reverse conveyance route 9, it is possible to prevent the printed first side 21 from being rubbed against any object and smudged. Hence, in the step of conveying the paper sheet 2 to the printing section 4 again in order to print the second side 22, the first side 21 can be effectively prevented from being smudged, thus making it possible to obtain the paper sheet 2 whose first and second sides 21 and 22 both have been beautifully printed.

(2) The reverse conveyance route 9 is formed without using rollers for sandwiching the paper sheet 2; therefore, it is possible to prevent loss of time, noise, and paper sheet jam, which have occurred in the case of the conventional switch-back system.

(3) The reverse conveyance route 9 is formed by a combination of a plurality of the reverse mechanisms for linearly conveying the paper sheet 2, reversing the paper sheet 2 along the curved inner peripheral surface, and further linearly conveying the paper sheet 2; therefore, it is possible to further achieve the following effects.

(a) The longitudinal size of the reverse conveyance route 9 can be smaller than that of the paper sheet 2 in the conveyance direction. Accordingly, the size of the entire device can be reduced.

(b) Since the paper sheet 2 is linearly conveyed when it goes into the reverse conveyance route 9, and is linearly conveyed when it goes out of the reverse conveyance route 9, the paper sheet 2 can be prevented from being deviated obliquely.

(4) Since the conveyance of the paper sheet 2 from the first conveyance route 6 to the second conveyance route 7 is performed via the suction roller 70, the conveyance of the paper sheet 2 can be performed without bringing the printed first side 21 into contact with any object. Accordingly, also in this structure, it is possible to prevent the printed first side 21 from being rubbed against any object and smudged in the second conveyance route 7.

(5) In the reverse conveyance route 9, the first conveyance section 91 mainly includes: the conveyance belts 912 having a large number of the through holes 9121; and the suction units 914 for sucking air through these through holes 9121, while the second conveyance section 93 mainly includes: the conveyance belt 932 having a large number of the through holes 9321; and the suction unit 934 for sucking air through these through holes 9321, thus making it possible to simply form the reverse conveyance route 9.

(6) Since the second conveyance route 7 is located around the device main body 10, the entire device can be compact in size.

Figure 12:
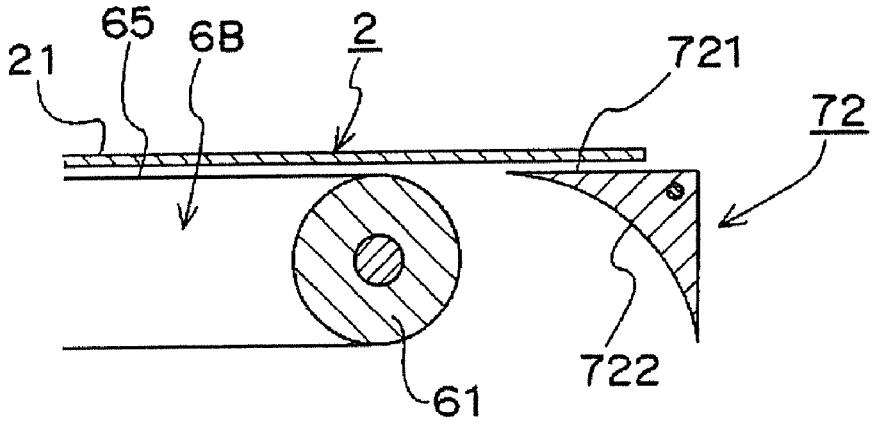
FIG. 12 is a longitudinal cross-sectional view showing an operation of a switching gate in a closed state.
Figure 13:
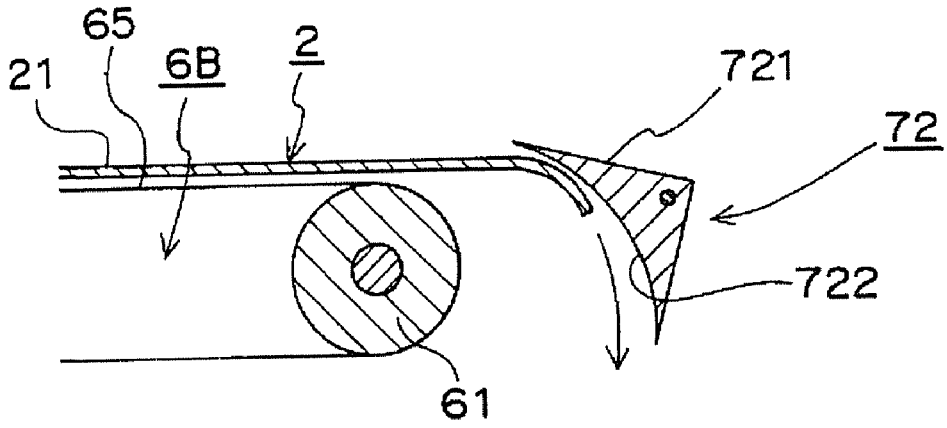
FIG. 13 is a longitudinal cross-sectional view showing an operation of the switching gate in an opened state.

It should be noted that if it might be impossible to sufficiently carry out the passing of the paper sheet 2 by the suction roller 70 because the suction force of the suction roller 70 is low, the first conveyance route 6 may be provided, at its terminal end, with a switching gate 72 as shown in FIGS. 12 and 13. In the case of a closed state shown in FIG. 12, the switching gate 72 guides the paper sheet 2, conveyed by the first conveyance route 6, automatically to the paper discharge section 8 along an outer surface 721, and in the case of an opened state shown in FIG. 13, the switching gate 72 guides the paper sheet 2, conveyed by the first conveyance route 6, to the suction roller 70 along a curved surface 722.

Second Embodiment

Figure 14:
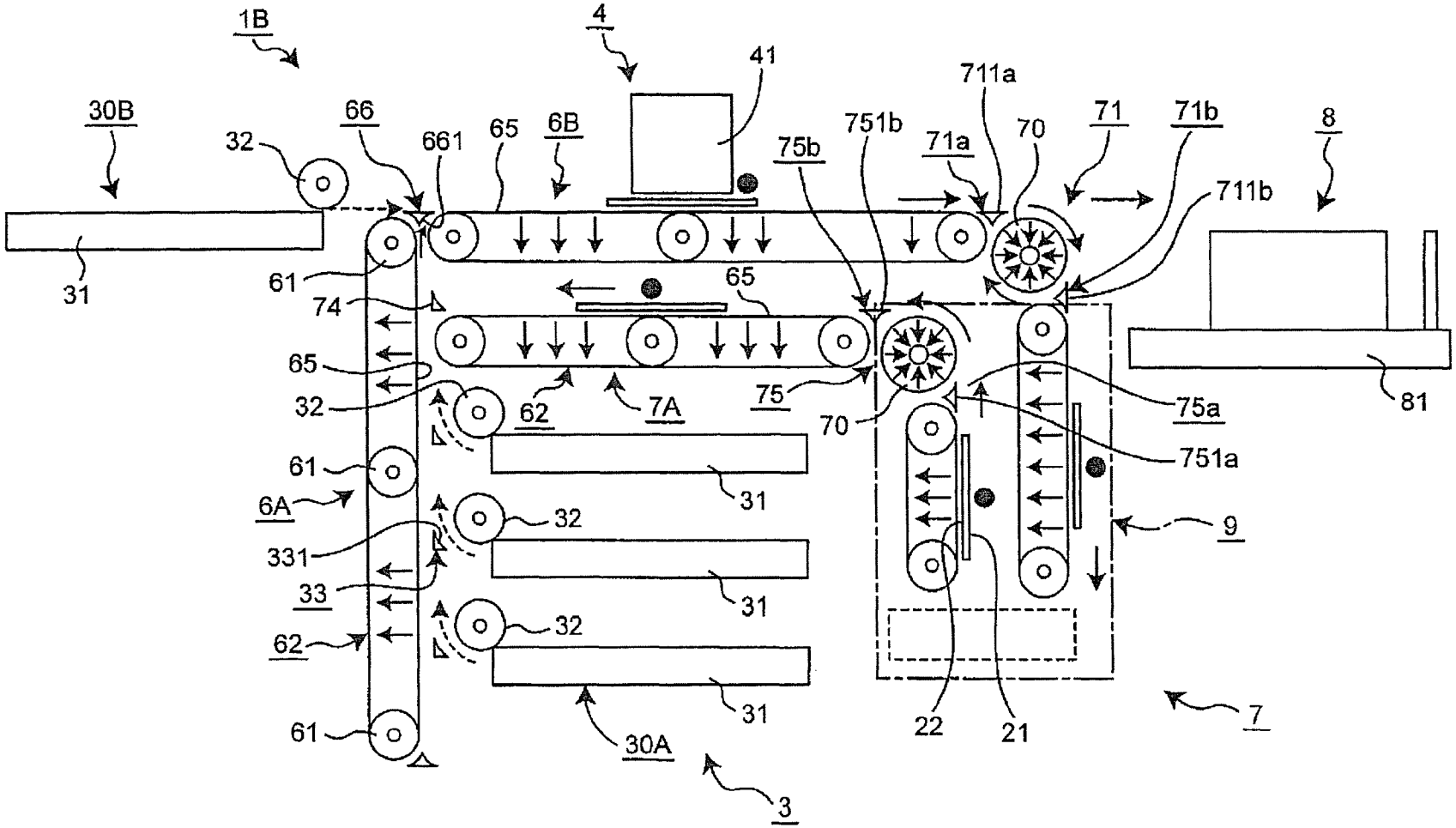
FIG. 14 is a schematic lateral cross-sectional view mainly showing conveyance routes of a double-sided printing device according to a second embodiment of the present invention.
Figure 15:
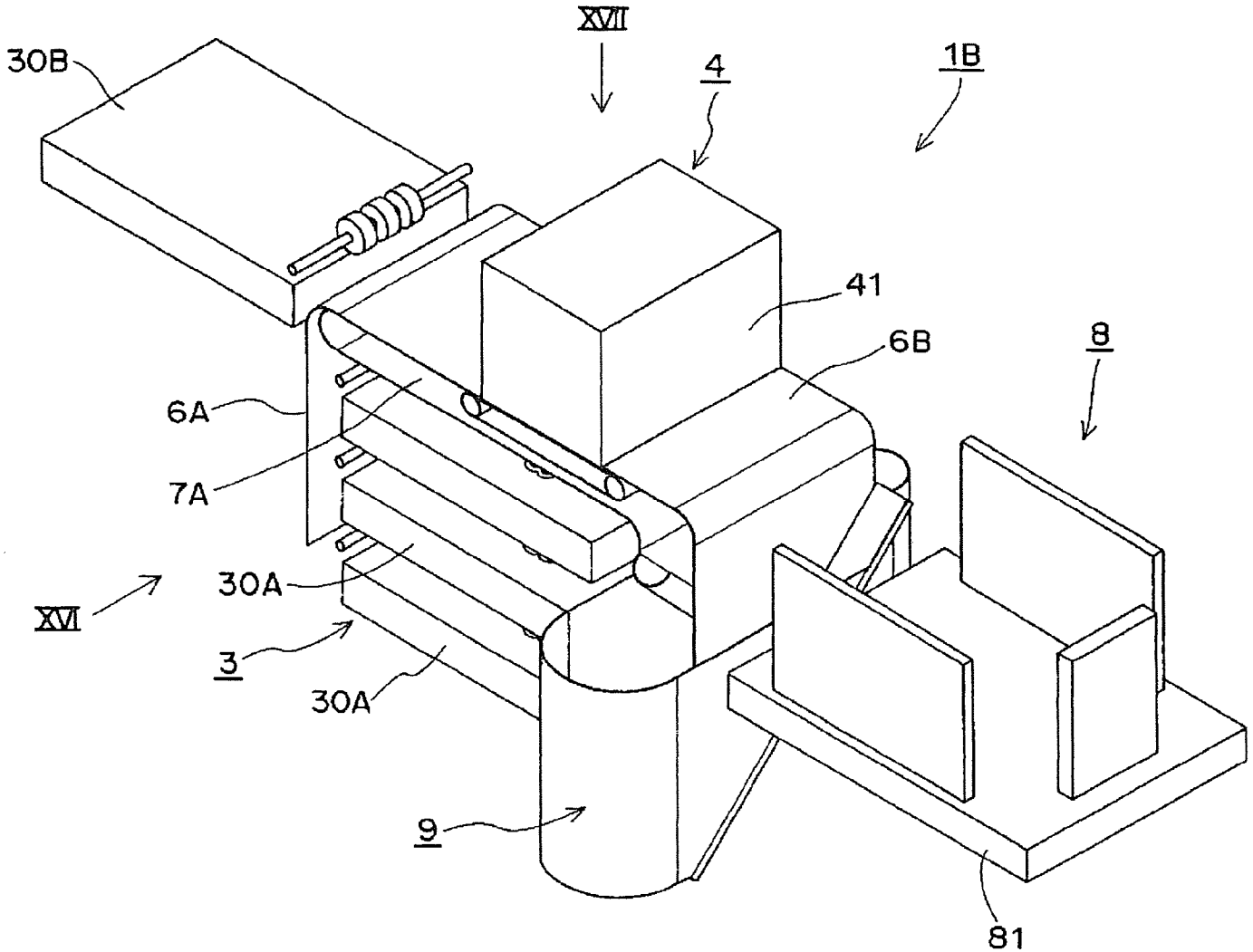
FIG. 15 is a schematic external perspective view of the double-sided printing device shown in FIG. 14.
Figure 16:
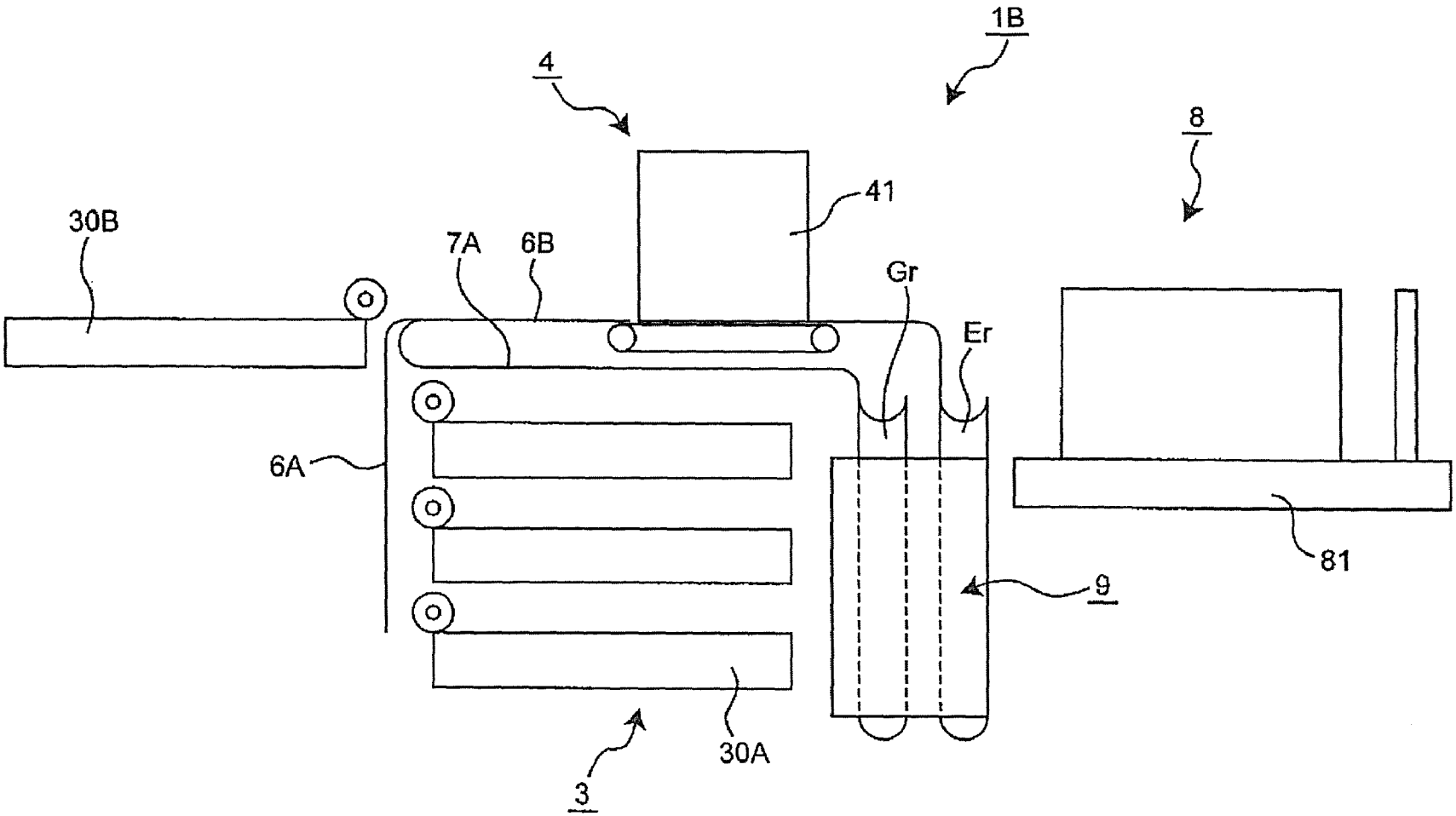
FIG. 16 is a diagram viewed from the arrow XVI of FIG. 15.
Figure 17:
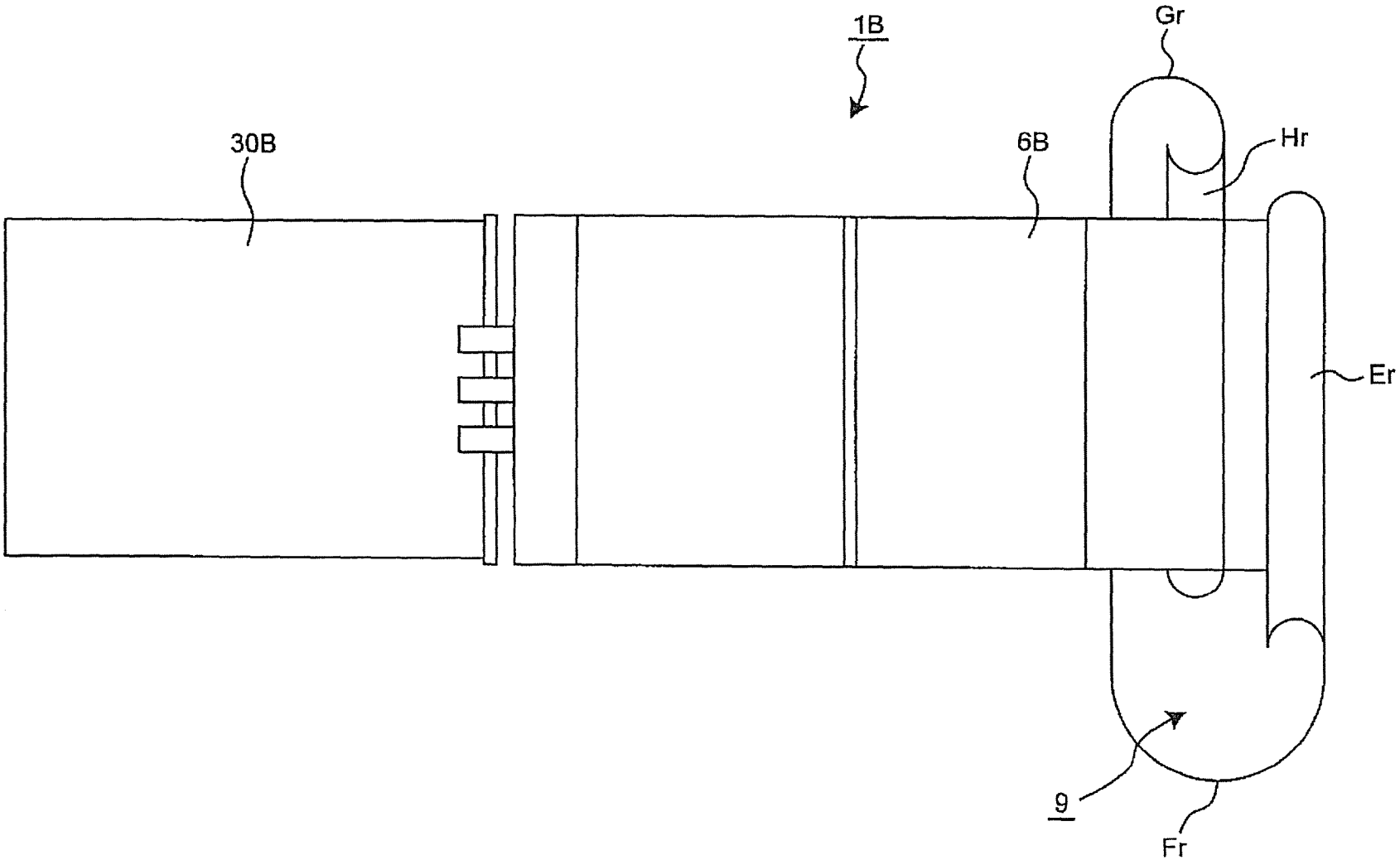
FIG. 17 is a diagram viewed from the arrow XVII of FIG. 15.

FIG. 14 is a schematic lateral cross-sectional view mainly showing conveyance routes of a double--sided printing device according to a second embodiment of the present invention. FIG. 15 is a schematic external perspective view of the double-sided printing device shown in FIG. 14. FIG. 16 is a diagram viewed from the arrow XVI of FIG. 15. FIG. 17 is a diagram viewed from the arrow XVII of FIG. 15.

Similarly to the double-sided printing device 1A according to the first embodiment, this double-sided printing device 1B also includes: the paper feeding section 3; the printing section 4; the first conveyance route 6; the second conveyance route 7; and the paper discharge section 8. It is to be noted that, in the double-sided printing device 1B, the conveyance section 7A of the second conveyance route 7 is located above the paper feeding section 3 and below the printing section 4. Further, the reverse conveyance route 9 has a structure different from that of the reverse conveyance route 9 according to the first embodiment so as to be communicated with the conveyance section 7A located in the above-described manner. Furthermore, between the terminal end of the reverse conveyance route 9 and the starting end of the conveyance section 7A, a forward guide section 75 is located.

Figure 18:
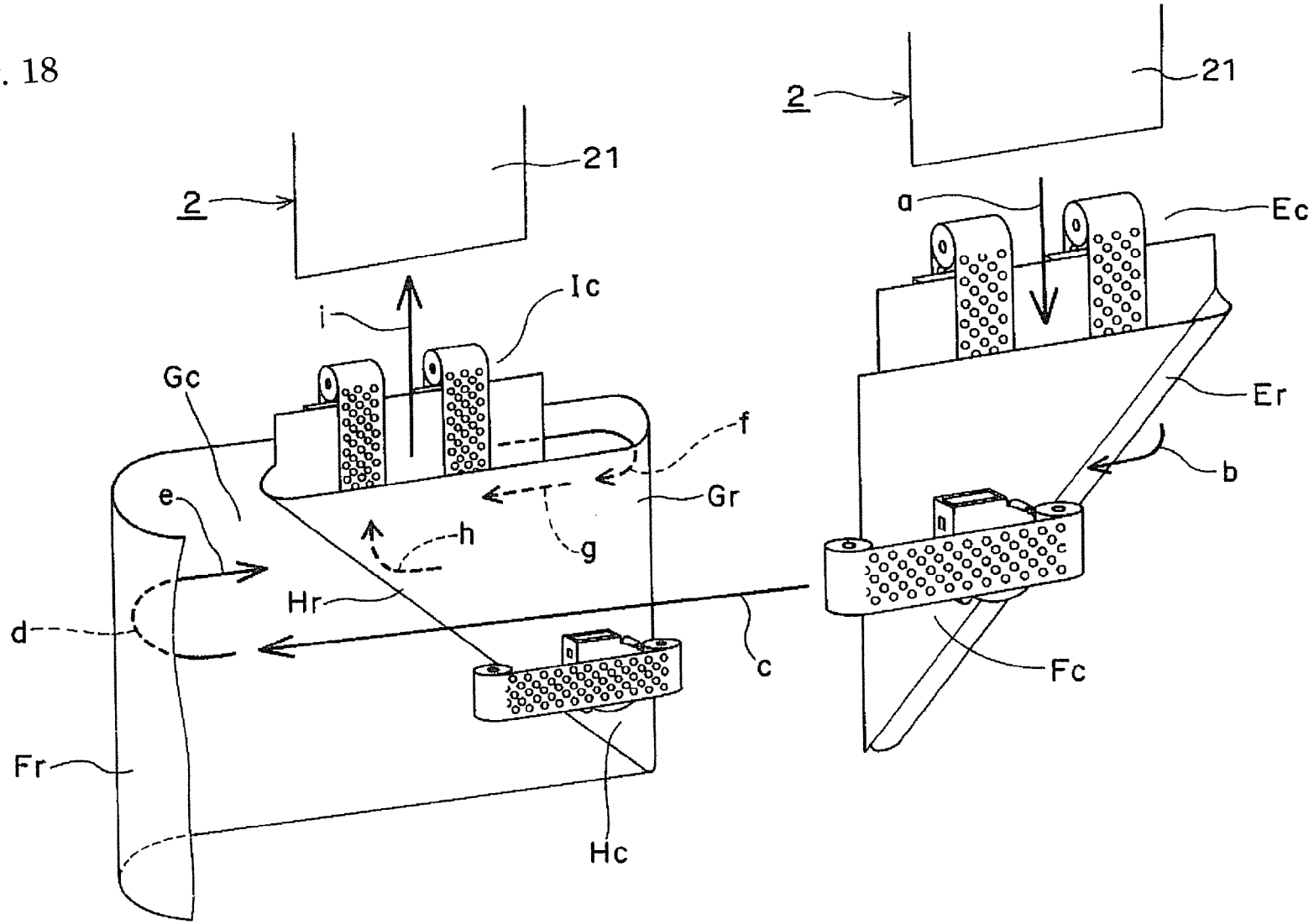
FIG. 18 is an exploded view showing a reverse conveyance route according to the second embodiment.

As shown in FIG. 18, the reverse conveyance route 9 is formed by a combination of four reverse mechanisms 9E, 9F, 9G and 9H. One of the reverse mechanisms is similar to one that is shown in FIG. 7. Further, in the reverse conveyance route 9 according to the present embodiment, as shown in FIG. 18, the reverse mechanism 9E is formed by a conveyance section Ec, a reverse section Er, and a conveyance section Fc, the reverse mechanism 9F is formed by the conveyance section Fc, a reverse section Fr, and a conveyance section Gc, the reverse mechanism 9G is formed by the conveyance section Gc, a reverse section Gr, and a conveyance section Hc, and the reverse mechanism 9H is formed by the conveyance section Hc, a reverse section Hr, and a conveyance section Ic. In other words, the conveyance section Ec serves as a first conveyance section of the reverse mechanism 9E, the conveyance section Fc serves as both of a second conveyance section of the reverse mechanism 9E and a first conveyance section of the reverse mechanism 9F, the conveyance section Gc serves as both of a second conveyance section of the reverse mechanism 9F and a first conveyance section of the reverse mechanism 9G, the conveyance section Hc serves as both of a second conveyance section of the reverse mechanism 9G and a first conveyance section of the reverse mechanism 9H, and the conveyance section Ic serves as a second conveyance section of the reverse mechanism 9H. It should be noted that the conveyance belt, etc. of the conveyance section Gc are not shown.

Similarly to the forward guide section 71, the forward guide section 75 includes conveyance guides 75*a* and 75*b* at the front and rear sides of the suction roller 70 in the conveyance direction thereof, respectively. The conveyance guide 75*a* guides the paper sheet 2, conveyed by the reverse conveyance route 9, to the suction roller 70 along a peripheral surface 751*a*, and the conveyance guide 75*b* guides the paper sheet 2, conveyed by the suction roller 70, to the conveyance section 7A along a peripheral surface 751*b*.

Hereinafter, how the double-sided printing device with the above-described structure operates will be described mainly with reference to FIG. 14.

Similarly to the first embodiment, upon operation of the device, first, the uppermost one of the paper sheets 2 stacked on the paper feeding tray 31 is sent out to the conveyance section 6A of the first conveyance route 6, and the paper sheet 2 is conveyed upward by the conveyance section 6A with the first side 21 attracted to the conveyance belt 62.

Next, similarly to the first embodiment, the paper sheet 2, conveyed by the conveyance section 6A, is placed onto the conveyance surface 65 of the conveyance section 6B, and is conveyed laterally with the second side 22 attracted to the conveyance belt 62. Then, the first side 21 is printed when the paper sheet 2 goes through the printing section 4.

Subsequently, similarly to the first embodiment, upon conveyance to the terminal end of the conveyance section 6B, the paper sheet 2, the first side 21 of which has been printed, is conveyed to the reverse conveyance route 9 via the forward guide section 71. The forward guide section 71 is operated similarly to the first embodiment.

Then, in the reverse conveyance route 9, the paper sheet 2 is conveyed while being reversed as follows. Specifically, as shown in FIG. 18, the paper sheet 2 sent from the suction roller 70 is linearly conveyed in the direction of an arrow a by the conveyance section Ec, reversed as indicated by an arrow b by the reverse section Er, linearly conveyed in the direction of an arrow c by the conveyance section Fc, reversed as indicated by an arrow d by the reverse section Fr, linearly conveyed in the direction of an arrow e by the conveyance section Gc, reversed as indicated by an arrow f by the reverse section Gr, linearly conveyed in the direction of an arrow g by the conveyance section Hc, reversed as indicated by an arrow h by the reverse section Hr, and then linearly conveyed in the direction of an arrow i by the conveyance section Ic. At this time, the second side 22 of the paper sheet 2 is received on all the conveyance surfaces. Furthermore, the direction in which the paper sheet 2 is conveyed when it goes into the conveyance section Ec (i.e., the direction of the arrow a) is opposite to the direction in which the paper sheet 2 is conveyed when it goes out of the conveyance section Ic (i.e., the direction of the arrow i).

Next, the paper sheet 2, conveyed by the conveyance section Ic of the reverse conveyance route 9, is guided to the conveyance section 7A via the forward guide section 75. The forward guide section 75 is operated similarly to the forward guide section 71. Then, the paper sheet 2 is conveyed laterally by the conveyance section 7A with the second side 22 attracted to the conveyance belt 62.

Subsequently, similarly to the first embodiment, the paper sheet 2 conveyed to the terminal end of the conveyance section 7A is guided to the conveyance section 6A along the curved surface 741 of the conveyance guide 74. Then, the paper sheet 2 is conveyed upward by a slight distance through the conveyance section 6A with the second side 22 attracted to the conveyance belt 62.

Next, similarly to the first embodiment, the paper sheet 2, conveyed by the conveyance section 6A, is placed onto the conveyance surface 65 of the conveyance section 6B, and is conveyed laterally by the conveyance section 6B with the first side 21 attracted to the conveyance belt 62. Then, the second side 22 is printed when the paper sheet 2 goes through the printing section 4.

Then, upon conveyance to the terminal end of the conveyance section 6B, similarly to the first embodiment, the paper sheet 2, the second side 22 of which has been printed, is guided to the paper discharge section 8 and is stored in the paper discharge tray 81.

Thus, the paper sheet 2, both sides of which, i.e., the first side 21 and the second side 22 of which, have been printed, is obtained.

The double-sided printing device 1B with the above-described structure can achieve effects similar to the effects (1) to (5) described in the first embodiment.

Furthermore, in the double-sided printing device 1B, the conveyance of the paper sheet 2 from the reverse conveyance route 9 to the conveyance section 7A is performed via the suction roller 70, and therefore, the conveyance of the paper sheet 2 can be performed without bringing the printed first side 21 into contact with any object. Accordingly, also in this structure, it is possible to prevent the printed first side 21 from being rubbed against any object and smudged in the second conveyance route 7.

Moreover, in the double-sided printing device 1B, the conveyance section 7A is located above the paper feeding section 3 and below the printing section 4; therefore, a space below the paper feeding section 3 can be open, thus making it possible to add a paper feeding cassette.

Third Embodiment

Figure 19:
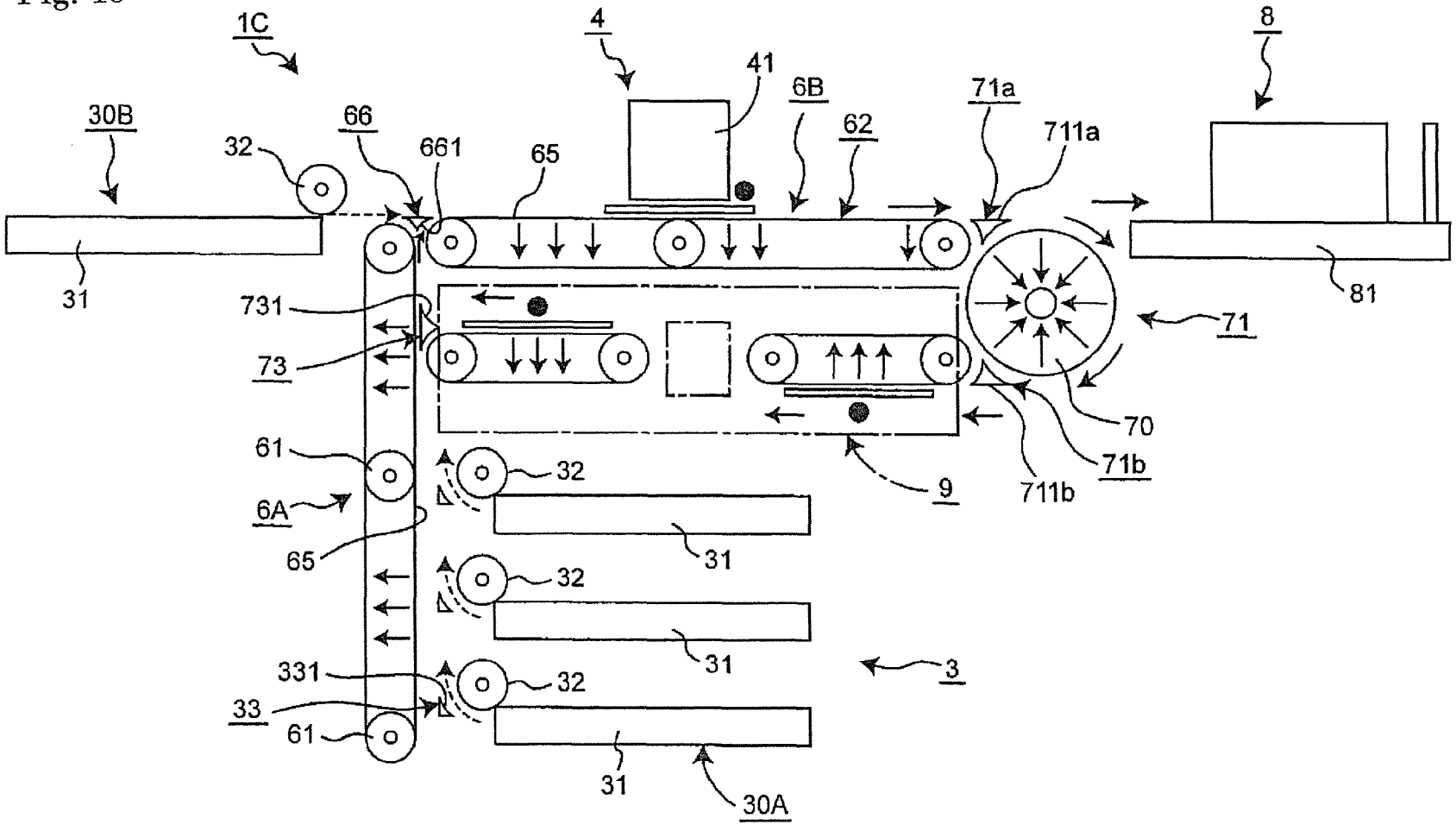
FIG. 19 is a schematic lateral cross-sectional view mainly showing conveyance routes of a double-sided printing device according to a third embodiment of the present invention.
Figure 20:
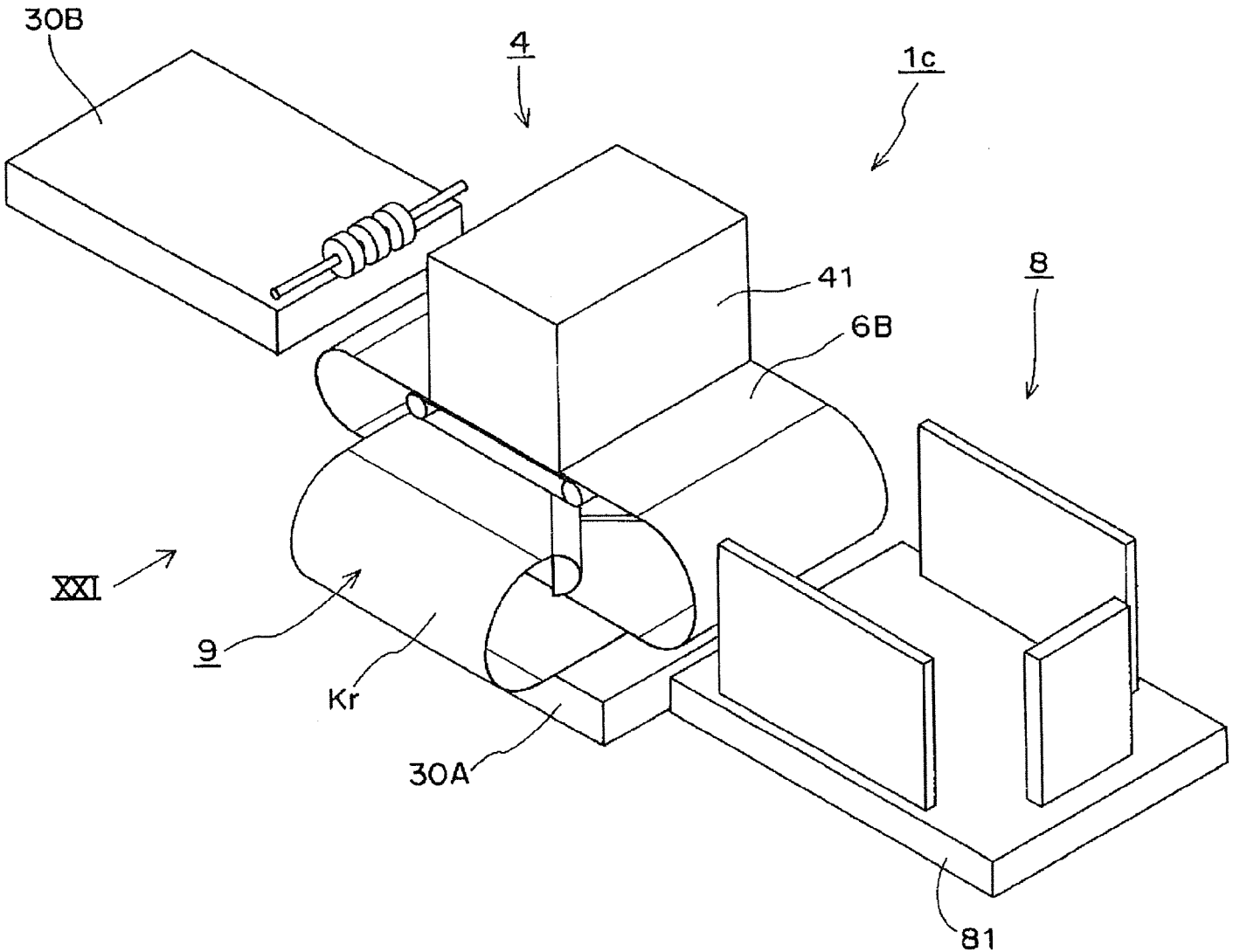
FIG. 20 is a schematic external perspective view of the double-sided printing device shown in FIG. 19.
Figure 21:
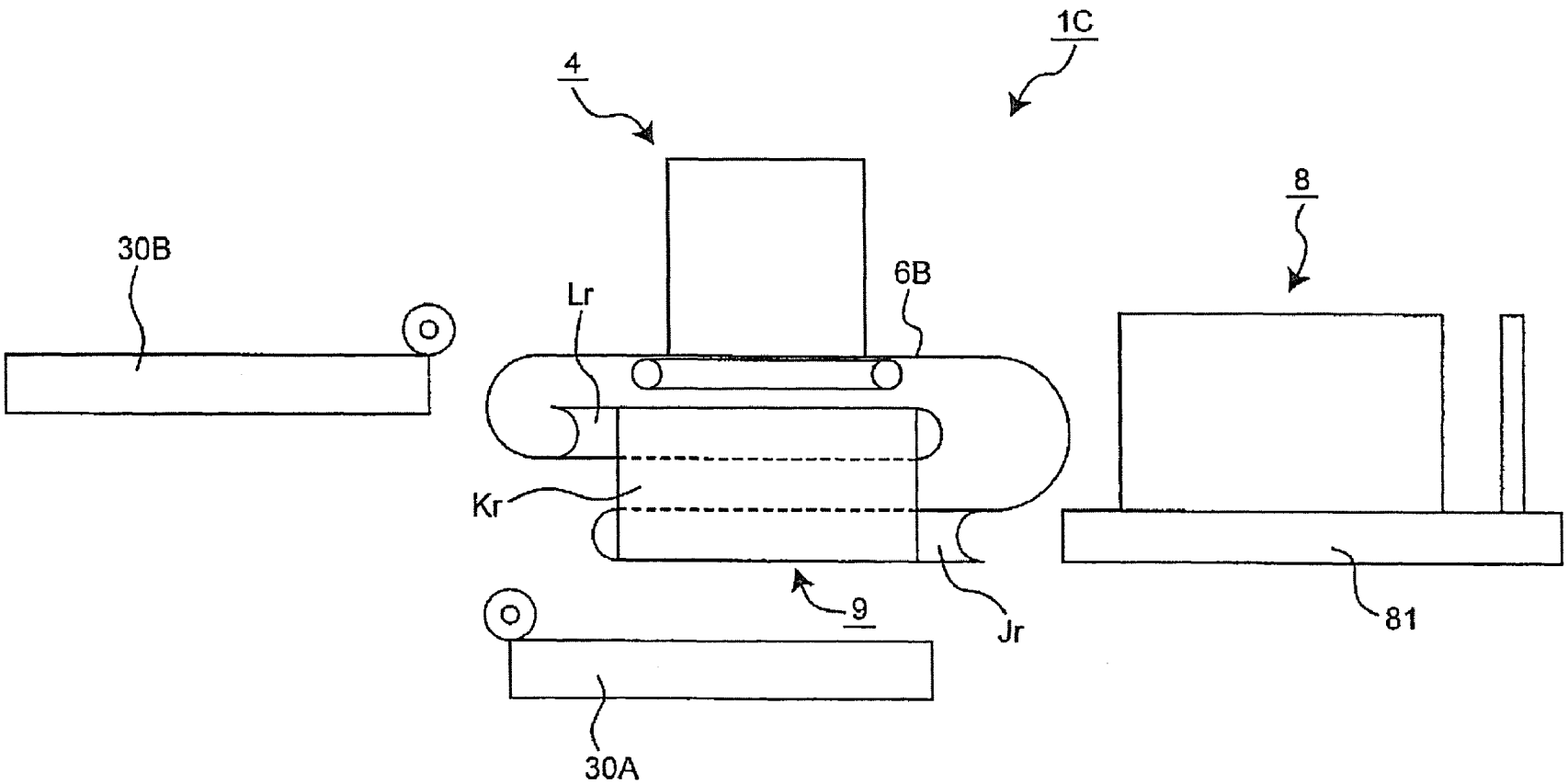
FIG. 21 is a diagram viewed from the arrow XXI of FIG. 20.

FIG. 19 is a schematic lateral cross-sectional view mainly showing conveyance routes of a double-sided printing device according to a third embodiment of the present invention. FIG. 20 is a schematic external perspective view of the double-sided printing device shown in FIG. 19. FIG. 21 is a diagram viewed from the arrow XXI of FIG. 20.

Similarly to the double-sided printing device 1A according to the first embodiment, this double-sided printing device 1C also includes: the paper feeding section 3; the printing section 4; the first conveyance route 6; the second conveyance route 7; and the paper discharge section 8. It is to be noted that, in the double-sided printing device 1C, the second conveyance route 7 does not have the conveyance section 7A. Further, the reverse conveyance route 9 is located above the paper feeding section 3 and below the printing section 4. Furthermore, the reverse conveyance route 9 has a structure different from that of the reverse conveyance route 9 according to the first embodiment.

Figure 22:
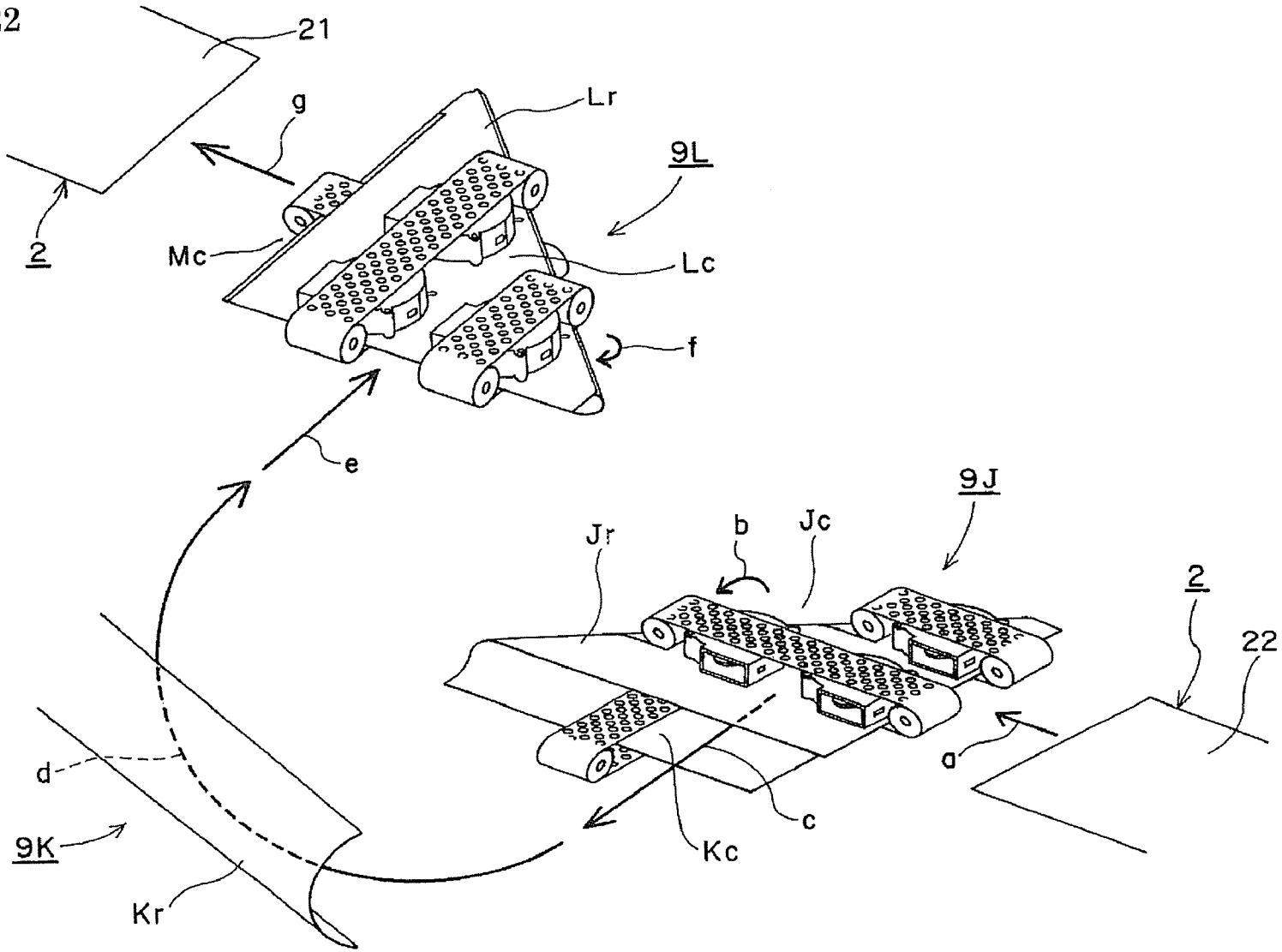
FIG. 22 is an exploded view showing a reverse conveyance route according to the third embodiment and a fourth embodiment.

As shown in FIG. 22, the reverse conveyance route 9 is formed by a combination of three reverse mechanisms 9J, 9K and 9L. One of the reverse mechanisms is similar to one that is shown in FIG. 7. Further, in the reverse conveyance route 9 according to the present embodiment, as shown in FIG. 22, the reverse mechanism 9J is formed by a conveyance section Jc, a reverse section Jr, and a conveyance section Kc, the reverse mechanism 9K is formed by the conveyance section Kc, a reverse section Kr, and a conveyance section Lc, and the reverse mechanism 9L is formed by the conveyance section Lc, a reverse section Lr, and a conveyance section Mc. In other words, the conveyance section Jc serves as a first conveyance section of the reverse mechanism 9J, the conveyance section Kc serves as both of a second conveyance section of the reverse mechanism 9J and a first conveyance section of the reverse mechanism 9K, the conveyance section Lc serves as both of a second conveyance section of the reverse mechanism 9K and a first conveyance section of the reverse mechanism 9L, and the conveyance section Mc serves as a second conveyance section of the reverse mechanism 9L.

Hereinafter, how the double-sided printing device with the above-described structure operates will be described mainly with reference to FIG. 19.

Similarly to the first embodiment, upon operation of the device, first, the uppermost one of the paper sheets 2 stacked on the paper feeding tray 31 is sent out to the conveyance section 6A of the first conveyance route 6, and the paper sheet 2 is conveyed upward by the conveyance section 6A with the first side 21 attracted to the conveyance belt 62.

Next, similarly to the first embodiment, the paper sheet 2 conveyed by the conveyance section 6A is placed onto the conveyance surface 65 of the conveyance section 6B, and is conveyed laterally with the second side 22 attracted to the conveyance belt 62. Then, the first side 21 is printed when the paper sheet 2 goes through the printing section 4.

Subsequently, similarly to the first embodiment, upon conveyance to the terminal end of the conveyance section 6B, the paper sheet 2, the first side 21 of which has been printed, is conveyed to the reverse conveyance route 9 via the forward guide section 71. The forward guide section 71 is operated similarly to the first embodiment.

Next, in the reverse conveyance route 9, the paper sheet 2 is reversed while being conveyed as follows. Specifically, as shown in FIG. 22, the paper sheet 2 sent from the suction roller 70 is linearly conveyed in the direction of an arrow a by the conveyance section Jc, reversed as indicated by an arrow b by the reverse section Jr, linearly conveyed in the direction of an arrow c by the conveyance section Kc, reversed as indicated by an arrow d by the reverse section Kr, linearly conveyed in the direction of an arrow e by the conveyance section Lc, reversed as indicated by an arrow f by the reverse section Lr, and then linearly conveyed in the direction of an arrow g by the conveyance section Mc. At this time, the second side 22 of the paper sheet 2 is received on all the conveyance surfaces. Furthermore, the direction in which the paper sheet 2 is conveyed when it goes into the conveyance section Jc (i.e., the direction of the arrow a) is identical to the direction in which the paper sheet 2 is conveyed when it goes out of the conveyance section Mc (i.e., the direction of the arrow g), and the paper sheet 2 is reversed through the reverse conveyance route 9.

Subsequently, the paper sheet 2, conveyed by the conveyance section Mc of the reverse conveyance route 9, is guided to the conveyance section 6A along the curved surface 731 of the conveyance guide 73. Then, the paper sheet 2 is conveyed upward by a slight distance through the conveyance section 6A with the second side 22 attracted to the conveyance belt 62.

Thereafter, operations similar to those in the first embodiment are performed. Thus, the paper sheet 2, both sides of which, i.e., the first side 21 and the second side 22 of which, have been printed, is obtained.

The double-sided printing device 1C with the above-described structure can achieve effects similar to the effects (1) to (5) described in the first embodiment.

Furthermore, in the double-sided printing device 1C, the reverse conveyance route 9 is located above the paper feeding section 3 and below the printing section 4; therefore, the lateral size of the device main body can be reduced, and the entire device can be more compact in size.

Moreover, in the double-sided printing device 1C, the conveyance section 7A does not pass below the paper feeding section 3; therefore, a space below the paper feeding section 3 can be open, thus making it possible to add a paper feeding cassette.

Fourth Embodiment

Figure 23:
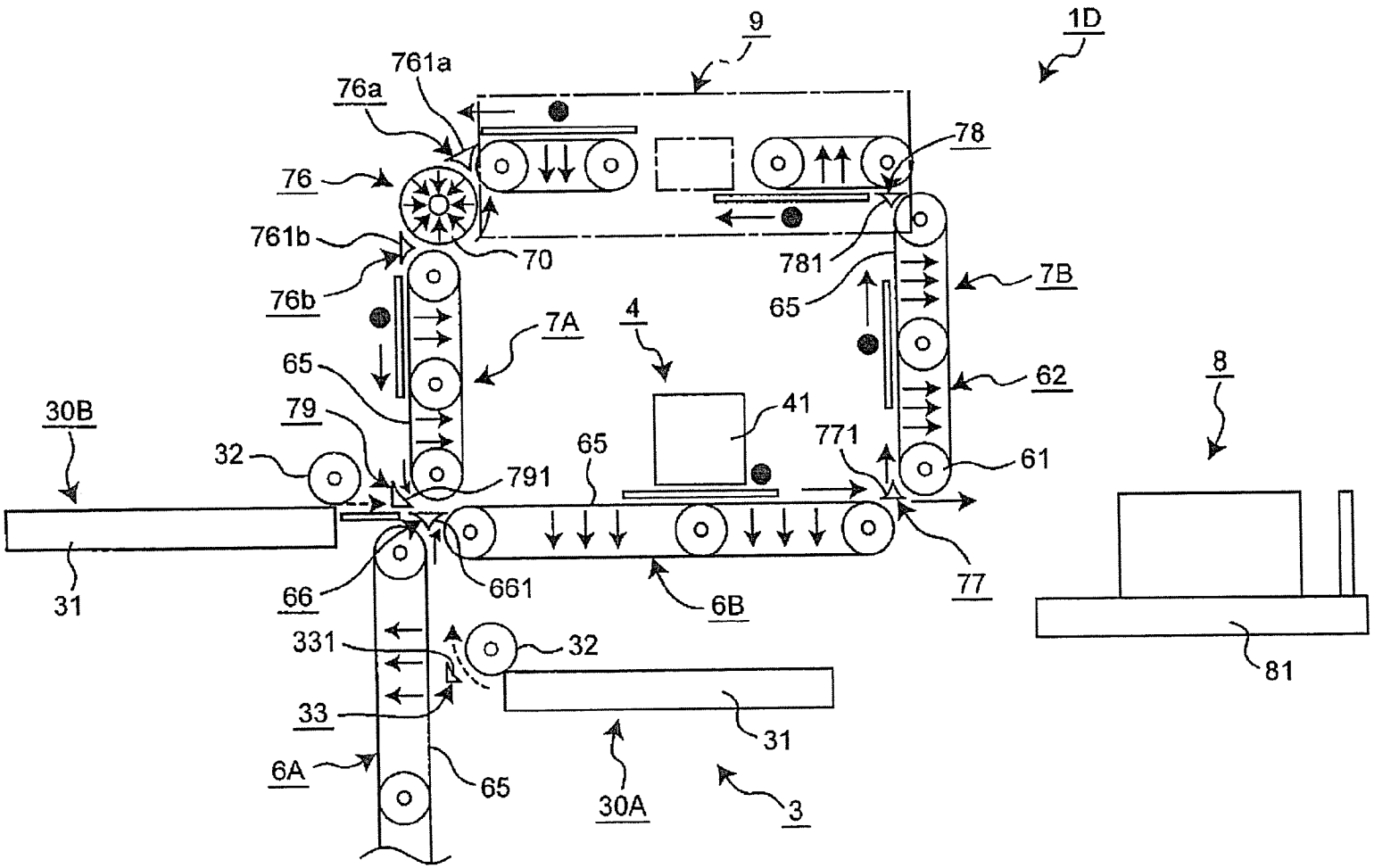
FIG. 23 is a schematic lateral cross-sectional view mainly showing conveyance routes of a double-sided printing device according to the fourth embodiment of the present invention.
Figure 24:
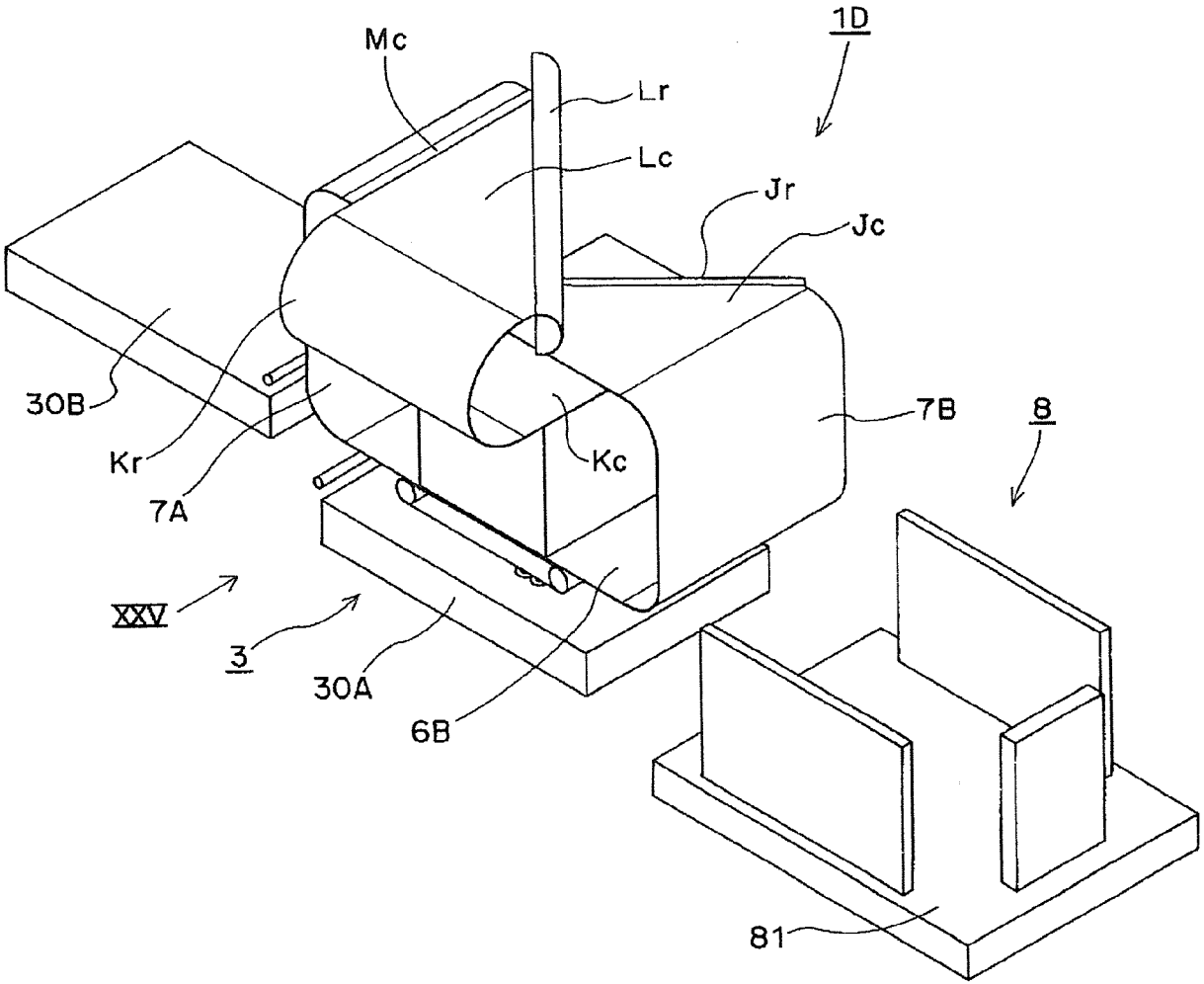
FIG. 24 is a schematic external perspective view of the double-sided printing device shown in FIG. 23.
Figure 25:
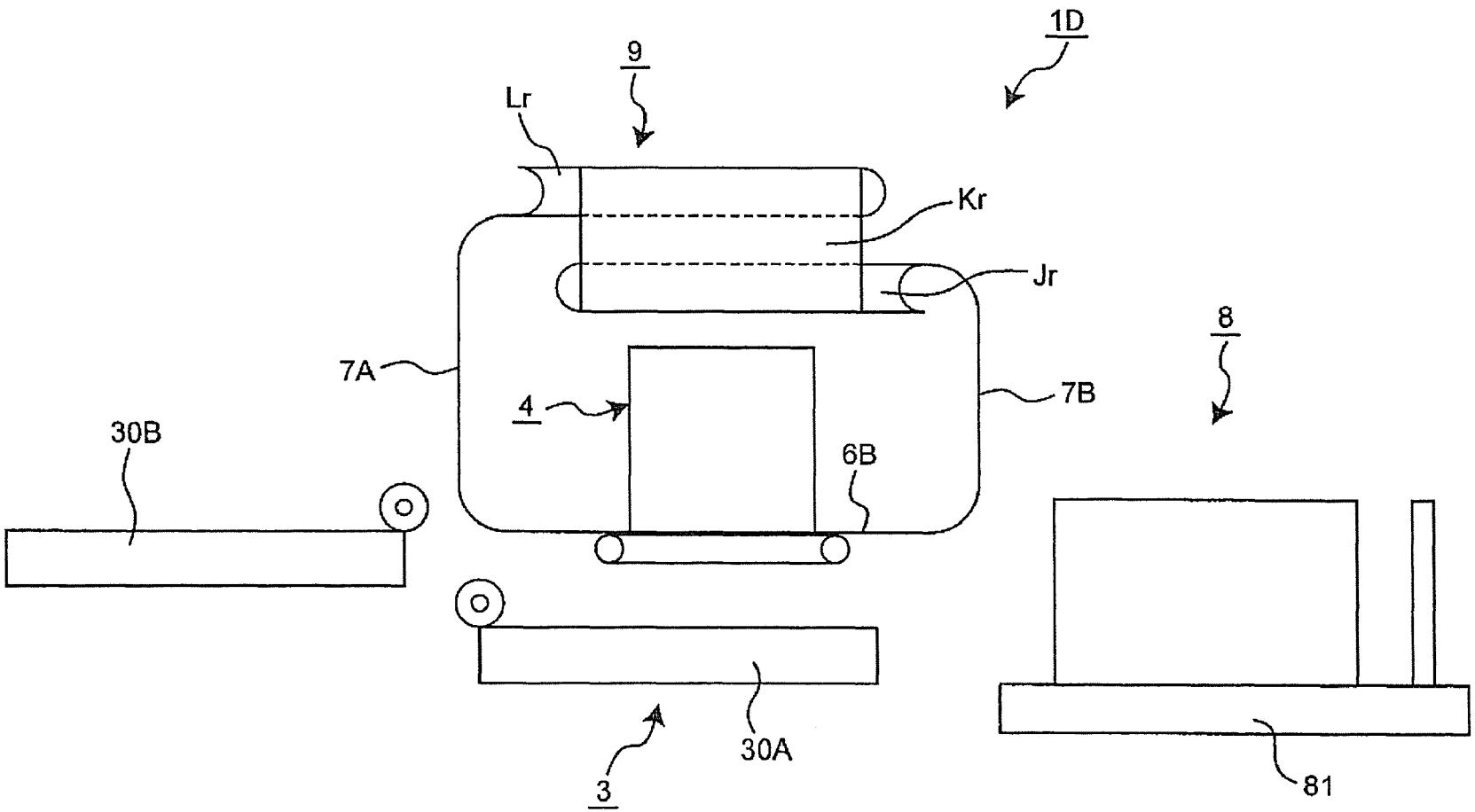
FIG. 25 is a diagram viewed from the arrow XXV of FIG. 24.

FIG. 23 is a schematic lateral cross-sectional view mainly showing conveyance routes of a double-sided printing device according to a fourth embodiment of the present invention. FIG. 24 is a schematic external perspective view of the double-sided printing device shown in FIG. 23. FIG. 25 is a diagram viewed from the arrow XXV of FIG. 24.

Similarly to the double-sided printing device 1A according to the first embodiment, this double-sided printing device 1D also includes: the paper feeding section 3; the printing section 4; the first conveyance route 6; the second conveyance route 7; and the paper discharge section 8. It is to be noted that, in the double-sided printing device 1D, the reverse conveyance route 9 is located above the printing section 4. Further, the second conveyance route 7 has a conveyance section 7B (third conveyance section) in addition to the conveyance section 7A. Furthermore, between the terminal end of the reverse conveyance route 9 and the starting end of the conveyance section 7A, a forward guide section 76 is located. Moreover, the second conveyance route 7 uses a diverting guide 79.

The conveyance section 7B has a structure similar to that of the conveyance section 6A. The conveyance section 7B is communicated, via a conveyance switching guide 77, with the terminal end of the conveyance section 6B of the first conveyance route 6, and is longitudinally extending upward. The conveyance switching guide 77 guides the paper sheet 2, conveyed by the conveyance section 6B, to the conveyance section 7B along a curved surface 771.

The reverse conveyance route 9 is communicated, via a conveyance guide 78, with a terminal end of the conveyance section 7B, and is extending laterally. The conveyance guide 78 guides the paper sheet 2, conveyed by the conveyance section 7B, to the reverse conveyance route 9 along a curved surface 781.

The reverse conveyance route 9 has a structure similar to that of the reverse conveyance route 9 according to the third embodiment.

The forward guide section 76 has a structure similar to that of the forward guide section 71 according to the second embodiment, and includes conveyance guides 76*a* and 76*b* at the front and rear sides of the suction roller 70 in the conveyance direction thereof, respectively. The conveyance guide 76*a* guides the paper sheet 2, conveyed by the reverse conveyance route 9, to the suction roller 70 along a curved surface 761*a*, and the conveyance guide 76*b* guides the paper sheet 2, conveyed by the suction roller 70, to the conveyance section 7A along a curved surface 761*b*.

The conveyance section 7A is communicated, via the forward guide section 76, with the terminal end of the reverse conveyance route 9, and is longitudinally extending downward. The terminal end of the conveyance section 7A is communicated, via the diverting guide 79, with the starting end of the conveyance section 6B of the first conveyance route 6. The diverting guide 79 guides the paper sheet 2, conveyed by the conveyance section 7A, to the conveyance section 6B along a curved surface 791, and guides the paper sheet 2 to the conveyance section 6B while bending the paper sheet 2 so that the first side 21 of the paper sheet 2, opposite to the second side 22 which has been received on the conveyance surface 65 of the conveyance section 7A, is received on the conveyance surface 65 of the conveyance section 6B.

Hereinafter, how the double-sided printing device with the above-described structure operates will be described mainly with reference to FIG. 23.

Similarly to the first embodiment, upon operation of the device, first, the uppermost one of the paper sheets 2 stacked on the paper feeding tray 31 is sent out to the conveyance section 6A of the first conveyance route 6, and the paper sheet 2 is conveyed upward by the conveyance section 6A with the first side 21 attracted to the conveyance belt 62.

Next, similarly to the first embodiment, the paper sheet 2 conveyed by the conveyance section 6A is placed onto the conveyance surface 65 of the conveyance section 6B, and is conveyed laterally with the second side 22 attracted to the conveyance belt 62. Then, the first side 21 is printed when the paper sheet 2 goes through the printing section 4.

Subsequently, upon conveyance to the terminal end of the conveyance section 6B, the paper sheet 2, the first side 22 of which has been printed, is guided to the conveyance section 7B along the curved surface 771 of the conveyance switching guide 77 because the conveyance switching guide 77 is set in a closed state. At this time, since the paper sheet 2 is moved while the second side 22 is brought into contact with the curved surface 771, the second side 22 is received on the conveyance surface 65 of the conveyance section 7B. Accordingly, the paper sheet 2 is conveyed upward by the conveyance section 7B with the second side 22 attracted to the conveyance belt 62.

Next, the paper sheet 2, conveyed by the conveyance section 7B, is guided to the reverse conveyance route 9 along the curved surface 781 of the conveyance guide 78. At this time, since the paper sheet 2 is moved while the second side 22 is brought into contact with the curved surface 781, the second side 22 is received on the conveyance surface of the conveyance section Jc of the reverse conveyance route 9.

Subsequently, in the reverse conveyance route 9, the paper sheet 2 is conveyed while being reversed in the manner similar to the reverse conveyance route 9 according to the third embodiment.

Next, the paper sheet 2, conveyed by the conveyance section Mc of the reverse conveyance route 9, is guided to the conveyance section 7A via the forward guide section 76. The forward guide section 76 is operated similarly to the forward guide section 75 according to the second embodiment. Then, the paper sheet 2 is conveyed downward by the conveyance section 7A with the second side 22 attracted to the conveyance belt 62.

Subsequently, the paper sheet 2, conveyed by the conveyance section 7A, is guided to the conveyance section 6B along the curved surface 791 of the diverting guide 79, and is placed onto the conveyance surface 65 of the conveyance section 6B. At this time, the paper sheet 2 is moved while the first side 21 is brought into contact with the curved surface 791, and the paper sheet 2 is reversed and placed onto the conveyance surface 65; therefore, the first side 21 is received on the conveyance surface 65. Accordingly, the paper sheet 2 is conveyed laterally by the conveyance section 6B with the first side 21 attracted to the conveyance belt 62. Then, the second side 22 is printed when the paper sheet 2 goes through the printing section 4.

Then, upon conveyance to the terminal end of the conveyance section 6B, the paper sheet 2, the second side 22 of which has been printed, automatically passes through the conveyance switching guide 77 so as to be guided to the paper discharge section 8 and stored in the paper discharge tray 81 because the conveyance switching guide 77 is set in an opened state. Thus, the paper sheet 2, both sides of which, i.e., the first side 21 and the second side 22 of which, have been printed, is obtained.

The double-sided printing device 1D with the above-described structure can achieve effects similar to the effects (1) to (5) described in the first embodiment.

Furthermore, since the reverse conveyance route 9 is located above the paper feeding section 3, the double-sided printing device 1D can achieve the following effects.

(a) The lateral size of the device main body is reduced, thereby allowing the entire device to be more compact in size.

(b) Even if a paper sheet jam has occurred in the reverse conveyance route 9, an operation for clearing the jam can be easily performed from above.

Moreover, in the double-sided printing device 1D, the conveyance section 7A does not pass below the paper feeding section 3; therefore, a space below the paper feeding section 3 can be open, thus making it possible to add a paper feeding cassette.

Figure 26:
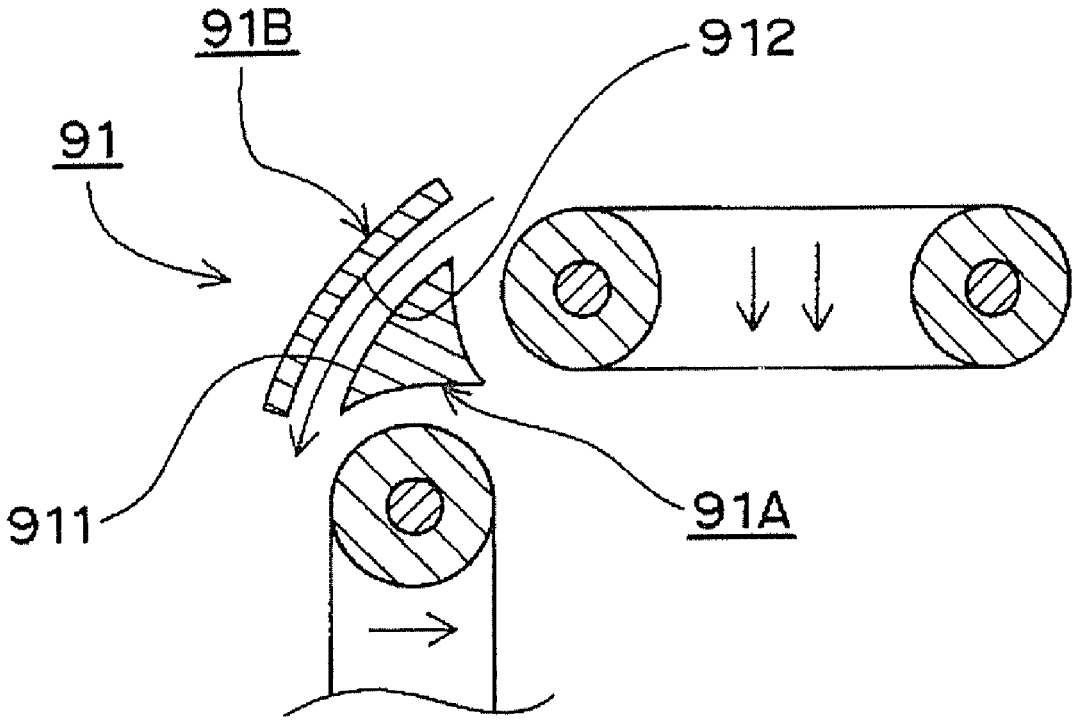
FIG. 26 is a longitudinal cross-sectional view showing another example of a forward guide section.

Other Embodiments (1) A conveyance guide 91 as shown in FIG. 26 may be used as each of the forward guide sections 71, 75 and 76. This conveyance guide 91 consists of an inner member 91A and an outer member 91B, and guides the paper sheet 2 via a gap 910 formed between a convex outer peripheral surface 911 of the inner member 91A and a concave inner peripheral surface 912 of the outer member 91B. With the use of this conveyance guide 91, in the second conveyance route 7, the paper sheet 2 is moved while the first side 21 is brought into contact with the concave inner peripheral surface 912.

It should be noted that, in the second conveyance route 7, it is not preferable that the first side 21 of the paper sheet 2 is rubbed against any object. However, for example, in the case of using the conveyance guide 91 instead of the forward guide section 76 in the fourth embodiment, the first side 21 is brought into contact with the concave inner peripheral surface 912 after a lapse of a long period of time following the printing, and therefore, the first side 21 is unlikely to be smudged.

Besides, in the conveyance guide 91, a process of imparting water repellency for repelling print ink is preferably performed on the concave inner peripheral surface 912 of the outer member 91B. As the process of imparting water repellency, fluorine coating, for example, can be adopted.

(2) As a structure for attracting the paper sheet 2 to the conveyance belt, a structure for electrostatically attracting the paper sheet 2 by electrostatically charging the conveyance belt by a charging means may be used. In this case, the conveyance belt requires no through holes.

(3) Each of the foregoing embodiments can also be applied to a double-sided copying device.

(4) In the foregoing embodiments, double-sided printing is performed; however, in the case of performing only single-sided printing, the paper sheet 2, the first side 21 of which has been printed, may be automatically sent to the paper discharge section 8 without being sent to the second conveyance route 7.

INDUSTRIAL APPLICABILITY

The double-sided image forming device of the present invention is capable of forming, without smudging one side on which an image has been formed, an image also on the other side, and is thus industrially very useful.

The invention claimed is:

1. A double-sided image forming device for forming an image on a first side of a paper sheet, and for subsequently reversing the paper sheet and conveying the paper sheet to an image forming section again, thereby forming an image also on a second side of the paper sheet, the double-sided image forming device comprising:

a paper feeding section for feeding a paper sheet;

an image forming section for forming an image on the paper sheet;

a first conveyance route for conveying a fed paper sheet to a paper discharge section via the image forming section; and a second conveyance route for receiving, on its conveyance surface, the paper sheet, on the first side of which an image has been formed, from the first conveyance route, and for conveying the paper sheet while reversing it, thereby conveying the paper sheet to the upstream side of the image forming section in the conveyance direction of the first conveyance route, wherein the second conveyance route has:

a forward guide section for guiding the paper sheet to the second conveyance route so that the second side of the paper sheet conveyed by the first conveyance route is received on the conveyance surface of the second conveyance route;

a reverse conveyance route for receiving, on its conveyance surface, the second side of the paper sheet, and for conveying the paper sheet while reversing it; and a diverting guide for guiding the paper sheet to the first conveyance route so that the first side of the paper sheet conveyed via the reverse conveyance route is received on a conveyance surface of the first conveyance route, and wherein the reverse conveyance route is formed by a combination of a plurality of reverse mechanisms each comprising: a first conveyance section for linearly conveying the paper sheet by attracting the second side of the paper sheet to a conveyance surface; a reverse section for receiving, on its conveyance surface formed by a curved inner peripheral surface, the second side of the paper sheet conveyed by the first conveyance section, and for reversing the paper sheet while bending it along the curved inner peripheral surface; and a second conveyance section for linearly conveying the paper sheet by attracting the second side of the reversed paper sheet to a conveyance surface, and the continuous reverse mechanisms are combined so that the second conveyance section of the preceding reverse mechanism also serves as the first conveyance section of the subsequent reverse mechanism.

2. The double-sided image forming device according to claim 1, wherein the forward guide section comprises a suction roller that is rotated with the second side of the paper sheet attracted thereto.

3. The double-sided image forming device according to claim 1, wherein the first conveyance section and/or the second conveyance section comprise(s): a conveyance belt having a large number of through holes; and a suction unit for sucking air through these through holes.

4. The double-sided image forming device according to claim 1, wherein the first conveyance section and/or the second conveyance section comprise(s): a conveyance belt; and charging means for electrostatically charging the conveyance belt.

5. The double-sided image forming device according to claim 1, wherein the second conveyance route further has: one or more third conveyance sections for linearly conveying the paper sheet by attracting the second side of the paper sheet to a conveyance surface; and a forward guide section located between the reverse conveyance route and the third conveyance section, wherein the forward guide section guides the paper sheet to the subsequent section so that the second side of the paper sheet conveyed by the preceding section, which is one of the reverse conveyance route and the third conveyance section, is received on the conveyance surface of the subsequent section, which is the other one of the reverse conveyance route and the third conveyance section, and wherein the forward guide section comprises a suction roller that is rotated with the second side of the paper sheet attracted thereto.

6. The double-sided image forming device according to claim 1, wherein the paper feeding section is located below the image forming section, wherein the reverse conveyance route is located next to the paper feeding section, and wherein a third conveyance section for linearly conveying the paper sheet by attracting the second side of the paper sheet to a conveyance surface is located so as to pass below the paper feeding section to reach the first conveyance route.

7. The double-sided image forming device according to claim 1, wherein the paper feeding section is located below the image forming section, wherein the reverse conveyance route is located next to the paper feeding section, and wherein a third conveyance section for linearly conveying the paper sheet by attracting the second side of the paper sheet to a conveyance surface is located so as to pass above the paper feeding section and below the image forming section to reach the first conveyance route.

8. The double-sided image forming device according to claim 1, wherein the paper feeding section is located below the image forming section, and wherein the reverse conveyance route is located above the paper feeding section and below the image forming section.

9. The double-sided image forming device according to claim 1, wherein the paper feeding section is located below the image forming section, and wherein the reverse conveyance route is located above the image forming section.

* * * * *